US012029945B1

(12) United States Patent
Terrell, II

(10) Patent No.: US 12,029,945 B1
(45) **Date of Patent: *Jul. 9, 2024**

(54) FITNESS EQUIPMENT CRUISE CONTROL WITH POWER RESERVE

(71) Applicant: EXERSCREEN INC., Charlotte, NC (US)

(72) Inventor: James Richard Terrell, II, Charlotte, NC (US)

(73) Assignee: EXERSCREEN INC., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/805,531

(22) Filed: Jun. 6, 2022

Related U.S. Application Data

(63) Continuation of application No. 16/725,931, filed on Dec. 23, 2019, now Pat. No. 11,351,421.

(60) Provisional application No. 62/783,948, filed on Dec. 21, 2018.

(51) Int. Cl.

| | |
|---|---|
| ***A63B 24/00*** | (2006.01) |
| ***A63B 21/22*** | (2006.01) |
| ***A63B 22/00*** | (2006.01) |
| ***A63B 71/06*** | (2006.01) |

(52) U.S. Cl.

CPC ..... *A63B 24/0087* (2013.01); *A63B 21/225* (2013.01); *A63B 22/0076* (2013.01); *A63B 24/0062* (2013.01); *A63B 71/0622* (2013.01); *A63B 2024/0093* (2013.01); *A63B 2071/065* (2013.01); *A63B 2225/52* (2013.01)

(58) Field of Classification Search

None

See application file for complete search history.

(56) References Cited

U.S. PATENT DOCUMENTS

| | | | | |
|---|---|---|---|---|
| 7,113,166 | B1 * | 9/2006 | Rosenberg | G09B 9/00 345/157 |
| 8,858,331 | B2 * | 10/2014 | Song | A63F 13/57 463/40 |
| 11,351,421 | B2 | 6/2022 | Terrell, II | |
| 2007/0061106 | A1 * | 3/2007 | Vock | G01P 15/00 702/182 |

(Continued)

OTHER PUBLICATIONS

Information Disclosure Statement (IDS) Letter Regarding Common Patent Application(s), dated Jul. 11, 2022.

*Primary Examiner* — Shila Jalalzadeh Abyaneh

(74) *Attorney, Agent, or Firm* — Tillman, Wright & Wolgin; James D. Wright; David R. Higgins

(57) ABSTRACT

A computer implemented system provides a cruise control function, during a fitness equipment-based workout, to report a power output amount based on a cruise control set-point. The system includes a piece of fitness equipment, a control device, and a computing device. The fitness equipment produces an output corresponding to actual power produced on the fitness equipment. The control device transmits an indication of power being produced to the computing device as an input to a fitness training game. In a first operational state, the indication represents the actual amount of power being produced via operation of the fitness equipment by the user, but in a second operational state, the numerical indication is a virtual power amount corresponding to a cruise control set-point amount established via the control device.

19 Claims, 41 Drawing Sheets

CRUISE CONTROL: BEING ENGAGED

POWER VALUE PROVIDED FROM APP TO TRAINER GAME = ACTUAL POWER = 147 WATTS

(56) References Cited

U.S. PATENT DOCUMENTS

| | | | | |
|---|---|---|---|---|
| 2013/0252786 | A1* | 9/2013 | Escobedo | A63B 24/00 482/8 |
| 2018/0126248 | A1* | 5/2018 | Dion | A63B 1/00 |
| 2020/0197748 | A1 | 6/2020 | Terrell, II | |

* cited by examiner

CRUISE CONTROL: DISENGAGED

POWER VALUE PROVIDED FROM APP TO TRAINER GAME = ACTUAL POWER = 0 WATTS

CRUISE CONTROL: DISENGAGED

POWER VALUE PROVIDED FROM APP TO TRAINER GAME = ACTUAL POWER = 125 WATTS

CRUISE CONTROL: DISENGAGED

POWER VALUE PROVIDED FROM APP TO TRAINER GAME = ACTUAL POWER = 147 WATTS

CRUISE CONTROL: BEING ENGAGED

POWER VALUE PROVIDED FROM APP TO TRAINER GAME = ACTUAL POWER = 147 WATTS

CRUISE CONTROL: ENGAGED

POWER VALUE PROVIDED FROM APP TO TRAINER GAME = CRUISE SETPOINT = 147 WATTS

CRUISE CONTROL: ENGAGED

POWER VALUE PROVIDED FROM APP TO TRAINER GAME = CRUISE SETPOINT = 147 WATTS

CRUISE CONTROL: ENGAGED

POWER VALUE PROVIDED FROM APP TO TRAINER GAME = CRUISE SETPOINT = 147 WATTS

CRUISE CONTROL: DISENGAGED

POWER VALUE PROVIDED FROM APP TO TRAINER GAME = ACTUAL POWER = 0 WATTS

CRUISE CONTROL: DISENGAGED

POWER VALUE PROVIDED FROM APP TO TRAINER GAME = ACTUAL POWER = 125 WATTS

CRUISE CONTROL: DISENGAGED

POWER VALUE PROVIDED FROM APP TO TRAINER GAME = ACTUAL POWER = 147 WATTS

CRUISE CONTROL: BEING ENGAGED

POWER VALUE PROVIDED FROM APP TO TRAINER GAME = ACTUAL POWER = 147 WATTS

CRUISE CONTROL: ENGAGED

ACTUAL POWER = CRUISE CONTROL SETPOINT

POWER VALUE PROVIDED FROM APP TO TRAINER GAME = ACTUAL POWER = 147 WATTS

CRUISE CONTROL: ENGAGED

ACTUAL POWER < CRUISE CONTROL SETPOINT

CRUZE RESERVE = 0

POWER VALUE PROVIDED FROM APP TO TRAINER GAME = ACTUAL POWER = 80 WATTS

CRUISE CONTROL: ENGAGED

ACTUAL POWER >= CRUISE CONTROL SETPOINT

POWER VALUE PROVIDED FROM APP TO TRAINER GAME = CRUISE SETPOINT = 147 WATTS

CRUISE CONTROL: ENGAGED

ACTUAL POWER >= CRUISE CONTROL SETPOINT

POWER VALUE PROVIDED FROM APP TO TRAINER GAME = CRUISE SETPOINT = 147 WATTS

CRUISE CONTROL: ENGAGED

ACTUAL POWER >= CRUISE CONTROL SETPOINT

POWER VALUE PROVIDED FROM APP TO TRAINER GAME = CRUISE SETPOINT = 147 WATTS

CRUISE CONTROL: ENGAGED

ACTUAL POWER < CRUISE CONTROL SETPOINT

CRUZE RESERVE > 0

POWER VALUE PROVIDED FROM APP TO TRAINER GAME = CRUISE SETPOINT = 147 WATTS

CRUISE CONTROL: ENGAGED

ACTUAL POWER < CRUISE CONTROL SETPOINT

CRUZE RESERVE > 0

POWER VALUE PROVIDED FROM APP TO TRAINER GAME = CRUISE SETPOINT = 147 WATTS

CRUISE CONTROL: ENGAGED

ACTUAL POWER < CRUISE CONTROL SETPOINT

CRUZE RESERVE > 0

POWER VALUE PROVIDED FROM APP TO TRAINER GAME = CRUISE SETPOINT = 147 WATTS

CRUISE CONTROL: ENGAGED

ACTUAL POWER < CRUISE CONTROL SETPOINT

CRUZE RESERVE > 0

POWER VALUE PROVIDED FROM APP TO TRAINER GAME = CRUISE SETPOINT = 147 WATTS

CRUISE CONTROL: ENGAGED

ACTUAL POWER < CRUISE CONTROL SETPOINT

CRUZE RESERVE = 0

POWER VALUE PROVIDED FROM APP TO TRAINER GAME = ACTUAL POWER = 0 WATTS

CRUISE CONTROL: BEING DISENGAGED

POWER VALUE PROVIDED FROM APP TO TRAINER GAME = CRUISE SETPOINT = 147 WATTS

CRUISE CONTROL: DISENGAGED

POWER VALUE PROVIDED FROM APP TO TRAINER GAME = ACTUAL POWER = 208 WATTS

CRUISE CONTROL: DISENGAGED

POWER VALUE PROVIDED FROM APP TO TRAINER GAME = ACTUAL POWER = 120 WATTS

CRUISE CONTROL: BEING ENGAGED

POWER VALUE PROVIDED FROM APP TO TRAINER GAME = ACTUAL POWER = 147 WATTS

CRUISE CONTROL: ENGAGED

ACTUAL POWER = CRUISE CONTROL SETPOINT

POWER VALUE PROVIDED FROM APP TO TRAINER GAME = ACTUAL POWER = 147 WATTS

CRUISE CONTROL: ENGAGED

ACTUAL POWER = CRUISE CONTROL SETPOINT

POWER VALUE PROVIDED FROM APP TO TRAINER GAME = ACTUAL POWER = 174 WATTS

CRUISE CONTROL: ENGAGED

ACTUAL POWER = CRUISE CONTROL SETPOINT

POWER VALUE PROVIDED FROM APP TO TRAINER GAME = ACTUAL POWER = 174 WATTS

CRUISE CONTROL: ENGAGED

ACTUAL POWER = CRUISE CONTROL SETPOINT

POWER VALUE PROVIDED FROM APP TO TRAINER GAME = ACTUAL POWER = 174 WATTS

CRUISE CONTROL: BEING ENGAGED

POWER VALUE PROVIDED FROM APP TO TRAINER GAME = ACTUAL POWER = 147 WATTS

CRUISE CONTROL: ENGAGED

POWER VALUE PROVIDED FROM APP TO TRAINER GAME = CRUISE SETPOINT = 100 WATTS

CRUISE CONTROL: ENGAGED

POWER VALUE PROVIDED FROM APP TO TRAINER GAME = CRUISE SETPOINT = 100 WATTS

FITNESS EQUIPMENT CRUISE CONTROL WITH POWER RESERVE

CROSS-REFERENCE TO RELATED APPLICATION

The present application is a U.S. continuation patent application of, and claims priority under 35 U.S.C. § 120 to, U.S. patent application Ser. No. 16/725,931, filed Dec. 23, 2019, which '931 application published as U.S. patent application publication no. US 2020/0197748 A1 on Jun. 25, 2020 and issued as U.S. Pat. No. 11,351,421 on Jun. 7, 2022, which '931 application, the application publication thereof, and the patent issuing therefrom are each incorporated herein by reference in their entirety, and which '931 is a nonprovisional patent application of, and claims priority under 35 U.S.C. § 119(e) to, U.S. provisional patent application 62/783,948, filed Dec. 21, 2018, which '948 application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to fitness equipment, and, in particular, to methods and systems that control how the power output produced by a user on a fitness machine is reported to a trainer game.

Background

Fitness machines, including are well known and increasing in popularity. Many fitness machines mechanically replicate corresponding outdoor fitness activities, thereby allowing athletes to train indoors during bad weather or when it is not convenient to practice outdoors. For example, indoor cycling trainers, rowing machines, and treadmills replicate outdoor cycling, rowing, and running or walking, respectively. Additional equipment can be used to more closely simulate the "real" experience. For example, cycling trainers like the Wahoo KICKR attach directly to a real bike.

Indoor training is effective but can be boring. Fortunately, modern technology has enhanced the indoor training experience. For example, many fitness machines are or can be integrated with hardware and/or software elements by measuring the power expended by the users. These types of trainers can transmit the power output of the athlete to software applications over Bluetooth®, ANT+, USB, or the like. Furthermore, training applications have been developed which take the power output of the fitness equipment and apply it to a virtual athlete, allowing for the gamification of online group workouts, sometimes in a virtual reality setting, which makes them more interesting. This has been particularly true with cycling, where applications include TrainerRoad, Rouvy, BKool, and Zwift. However, the popularity of "trainer games" like Zwift has also led to their adaptation to other non-cycling fitness machines. For example, the PainSled iOS application receives power measurements from a Concept2 rowing machine and can then present this information as an emulated cycling trainer, allowing rowing athletes to "play" cycling trainer games as if they were a cyclist in order to liven up their training sessions.

The communal group participation aspect of such training games is one of its most popular features. However, full participation is often based on maintaining a level of effort sufficient to keep up with the rest of the group. For example, cycling trainer games like Zwift involve riding with a group of cyclists, commonly known as "pelotons." Staying with the peloton requires continuous output of energy over long periods of time, e.g., 1-4 hours, since virtual cycling races or training sessions can mimic outdoor races of that length. In some training games, falling off the back of the peloton effectively ends the athlete's participation in the workout. In other cases, the athlete's workout score is penalized for being dropped. In any case, it is a bad thing to lose the peloton. Thus, if a participant has to take an unexpected break, the entire training experience is effectively ended.

This is even more problematic in the adaptation of such training games for other fitness activities. More particularly, cyclists can often still use their hands while riding real bikes in order to get a drink of water, eat energy snacks, or perform other brief manual tasks. Bikes mounted on cycling trainers are more stable than real bikes and allow the athlete to go completely hands-free when necessary. In fact, cycling trainer games take advantage of this and allow athletes to do things like type chat messages to each other while working out as a group online, or adjust game settings in the game application while "riding." By contrast, however, other types of athletes, and their corresponding fitness machines, require the mostly full-time use of the athletes' hands, making it difficult for the athletes to fully participate in cycling trainer games and cause problems even in training games customized for the particular fitness machine. For example, it is very difficult for an athlete on a rowing machine but participating in a "peloton" (by emulating a cycling trainer) to pause long enough to send a chat message, or to get a drink or a snack, without falling behind the "peloton" or losing "points" in a gamified group workout. Thus, a need exists for a tool that enables athletes engaged in a lengthy fitness activity to pause their workout without ending their participation in a trainer game or the like.

Unfortunately, although simply enabling a user to pause a workout without ending their participation in a group workout is useful in its own right, it is also recognized that use of such a feature might destroy the integrity of the workout, particularly in a group workout but also for individuals tracking their workouts closely. Indeed, such a feature might be used intentionally by some users to "cheat" in a group workout. Thus, it would be desirable to have a solution that facilitates pauses while still maintaining the integrity of the overall workout, such as by letting a user work harder during one portion of a workout to make up for reducing his or her workout level, or pausing it entirely, during another portion of the workout.

SUMMARY OF THE PRESENT INVENTION

Some exemplary embodiments of the present invention may overcome one or more of the above disadvantages and other disadvantages not described above, but the present invention is not required to overcome any particular disadvantage described above, and some exemplary embodiments of the present invention may not overcome any of the disadvantages described above.

Broadly defined, the present invention according to one aspect may relate to a computer implemented method for providing a cruise control function, during a fitness equipment-based workout, to report a power output amount based on a cruise control set-point, including: during a workout carried out for a period of time on a piece of fitness equipment, (i) producing, by the fitness equipment, an output corresponding to an actual amount of power being produced via operation of the fitness equipment by a user, (ii) receiving the output at a control device, (iii) at least intermittently transmitting, by the control device, a data signal whose content includes a numerical indication of an amount of power to be used as an input by a fitness game or other application, wherein the fitness game or other application is implemented on computing device, and wherein the numerical indication may or may not represent the actual amount of power being produced, (iv) receiving, at the computing device, the data signal, and (v) in the fitness game or other application, using the numerical indication included in the received data signal as the amount of power being produced by the user of the fitness equipment; wherein, in a first operational state, the numerical indication included in the content of the transmitted and received data signal represents the actual amount of power being produced via operation of the fitness equipment by the user; and wherein, in a second operational state, the numerical indication included in the content of the transmitted and received data signal is a virtual power amount corresponding to a cruise control set-point amount that is established via, and under the control of, the control device such that the fitness game or other application interprets the cruise control set-point amount as the actual amount of power being produced by the user of the fitness equipment.

In a feature of this aspect, the output produced by the fitness equipment is a data signal whose content includes a numerical indication of the actual amount of power being produced via operation of the fitness equipment by the user.

In another feature of this aspect, the output produced by the fitness equipment is a numeric or alphanumeric display that numerically indicates the actual amount of power being produced via operation of the fitness equipment by the user, the control device receives the output via a camera aimed at the display, and the control device implements optical character recognition (OCR) software that converts the output received via the camera into a numerical indication of the actual amount of power being produced via operation of the fitness equipment by the user.

In another feature of this aspect, in the output produced by the fitness equipment is an audible noise having one or more attributes corresponding to mechanical motion of the fitness equipment, the attributes corresponding to the mechanical motion are adapted for interpretation as the actual amount of power being produced via the operation of the fitness equipment by the user, the control device receives the output via a microphone, and the control device implements sound processing software that converts the audible noise received via the microphone into a numerical indication of the actual amount of power being produced via operation of the fitness equipment by the user.

In another feature of this aspect, the control device implements a cruise control application that establishes the cruise control set-point amount. In further features, the cruise control application controls whether the control device is in the first operational state or the second operational state; the method further includes a step, while in the first operational state, of receiving, by the control device, an input interpreted as a command to change from the first operational state to the second operational state; the method further includes a subsequent step, while in the second operational state, of receiving, by the control device, an input interpreted as a command to change from the second operational state back to the first operational state; the method further includes a subsequent step, while in the second operational state, of forcing operation to return from the second operational state back to the first operational state when a particular condition exists as determined by the control device; the method further includes a step of displaying, via a graphical user interface forming part of the cruise control application, the cruise control set-point amount; the method further includes a step of receiving, by the control device, an input that establishes the cruise control set-point amount; the step of receiving an input that establishes the cruise control set-point amount includes receiving an input that establishes the cruise control set-point amount as the then-current actual amount of power being produced via operation of the fitness equipment by the user; the step of receiving an input that establishes the cruise control set-point amount includes receiving direct entry of a value to be used as the cruise control set-point amount; the step of receiving an input that establishes the cruise control set-point amount includes selection of a pre-defined set-point value, from a plurality of different pre-defined set-point values, and using the selected value as the cruise control set-point amount; the operation of the control device in the second operational state is related to the accumulation of reserve power as tracked by the cruise control application; when in the second operational state, if the actual amount of power being produced via operation of the fitness equipment by the user is greater than the virtual power amount that corresponds to the cruise control set-point amount, then the reserve power, as tracked by the cruise control application, is increased accordingly; when in the second operational state, if the actual amount of power being produced via operation of the fitness equipment by the user is less than the virtual power amount that corresponds to the cruise control set-point amount, then the reserve power, as tracked by the cruise control application, is decreased accordingly; if the reserve power, as tracked by the cruise control application, reaches zero, then the control device causes operation to return from the second operational state back to the first operational state, and the data signal transmitted by the control device indicates the actual amount of power being produced via operation of the fitness equipment by the user; the accumulated reserve power is measured in units of power per unit of time; the reserve power is accumulated based on the difference between the actual amount of power amount produced and the virtual power amount over a period of time; and/or the reserve power is depleted based on the difference between the virtual power amount and the actual amount of power amount produced over a period of time.

In another feature of this aspect, the fitness equipment includes an integrated equipment controller and a sensor that detects one or more attributes corresponding to mechanical motion of the fitness equipment and outputs a signal along a communication path from the sensor to the integrated equipment controller, and the method further includes intercepting the sensor output signal at an intermediate device, and the output produced by the fitness equipment is the sensor output signal. In further features, the equipment controller or the control device implements software that converts the sensor output signal into a numerical indication of the actual amount of power being produced via operation of the fitness equipment by the user; and/or the sensor output signal includes a numerical indication of the actual amount of power being produced via operation of the fitness equipment by the user.

Broadly defined, the present invention according to another aspect may relate to a computer implemented method for providing a cruise control function, during a fitness equipment-based workout, to report a power output amount based on a cruise control set-point, including: during a workout carried out for a period of time on a piece of fitness equipment having an integrated equipment controller, (i) producing, by the fitness equipment, an output corresponding to an actual amount of power being produced via operation of the fitness equipment by a user, (ii) receiving the output at the equipment controller, (iii) at least intermittently transmitting, by the equipment controller, a data signal whose content includes a numerical indication of an amount of power to be used as an input by a fitness game or other application, wherein the fitness game or other application is implemented on computing device, and wherein the numerical indication may or may not represent the actual amount of power being produced, (iv) receiving, at the computing device, the data signal, and (v) in the fitness game or other application, using the numerical indication included in the received data signal as the amount of power being produced by the user of the fitness equipment; wherein, in a first operational state, the numerical indication included in the content of the transmitted and received data signal represents the actual amount of power being produced via operation of the fitness equipment by the user; and wherein, in a second operational state, the numerical indication included in the content of the transmitted and received data signal is a virtual power amount corresponding to a cruise control set-point amount that is established via, and under the control of, the equipment controller such that the fitness game or other application interprets the cruise control set-point amount as the actual amount of power being produced by the user of the fitness equipment.

In a feature of this aspect, the equipment controller implements a cruise control application that establishes the cruise control set-point amount. In further features, the cruise control application controls whether the equipment controller is in the first operational state or the second operational state; and/or the operation of the equipment controller in the second operational state is related to the accumulation of reserve power as tracked by the cruise control application.

Broadly defined, the present invention according to another aspect may relate to a computer implemented method for providing a cruise control function, during a fitness equipment-based workout, to report a power output amount based on a cruise control set-point, including: during a workout carried out for a period of time on a piece of fitness equipment, (i) receiving, at a control device, an output corresponding to an actual amount of power being produced via operation of the fitness equipment, (ii) at least intermittently transmitting, by the control device, a data signal whose content includes a numerical indication of an amount of power to be used as an input by a fitness game or other application, wherein the fitness game or other application is implemented on computing device, and wherein the numerical indication may or may not represent the actual amount of power being produced, but wherein the numerical indication included in the received data signal is intended to be used in either case as the amount of power being produced by the user of the fitness equipment; wherein, in a first operational state, the numerical indication included in the content of the transmitted and received data signal represents the actual amount of power being produced via operation of the fitness equipment by the user; and wherein, in a second operational state, the numerical indication included in the content of the transmitted and received data signal is a virtual power amount corresponding to a cruise control set-point amount that is established via, and under the control of, the control device such that the fitness game or other application interprets the cruise control set-point amount as the actual amount of power being produced by the user of the fitness equipment.

In a feature of this aspect, the control device implements a cruise control application that establishes the cruise control set-point amount. In further features, the cruise control application controls whether the control device is in the first operational state or the second operational state; and/or the operation of the control device in the second operational state is related to the accumulation of reserve power as tracked by the cruise control application.

Broadly defined, the present invention according to another aspect may relate to a computer implemented system for providing a cruise control function, during a fitness equipment-based workout, to report a power output amount based on a cruise control set-point, including: a piece of fitness equipment that produces an output corresponding to an actual amount of power being produced via operation of the fitness equipment by a user; a control device that receives the output from the fitness equipment and at least intermittently transmits a data signal whose content includes a numerical indication of an amount of power to be used as an input by a fitness game or other application, and wherein the numerical indication may or may not represent the actual amount of power being produced; and a computing device that implements the fitness game or other application, wherein the computing device receives the data signal and uses the numerical indication included in the received data signal as the amount of power being produced by the user of the fitness equipment; wherein, in a first operational state, the numerical indication included in the content of the transmitted and received data signal represents the actual amount of power being produced via operation of the fitness equipment by the user; and wherein, in a second operational state, the numerical indication included in the content of the transmitted and received data signal is a virtual power amount corresponding to a cruise control set-point amount that is established via, and under the control of, the control device such that the fitness game or other application interprets the cruise control set-point amount as the actual amount of power being produced by the user of the fitness equipment.

In a feature of this aspect, the control device implements a cruise control application that establishes the cruise control set-point amount. In further features, the cruise control application controls whether the control device is in the first operational state or the second operational state; and/or the operation of the control device in the second operational state is related to the accumulation of reserve power as tracked by the cruise control application Further areas of applicability of the present invention will become apparent from the detailed description provided hereinafter. It should be understood that the detailed description and specific examples, while indicating preferred embodiment(s) of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1A:
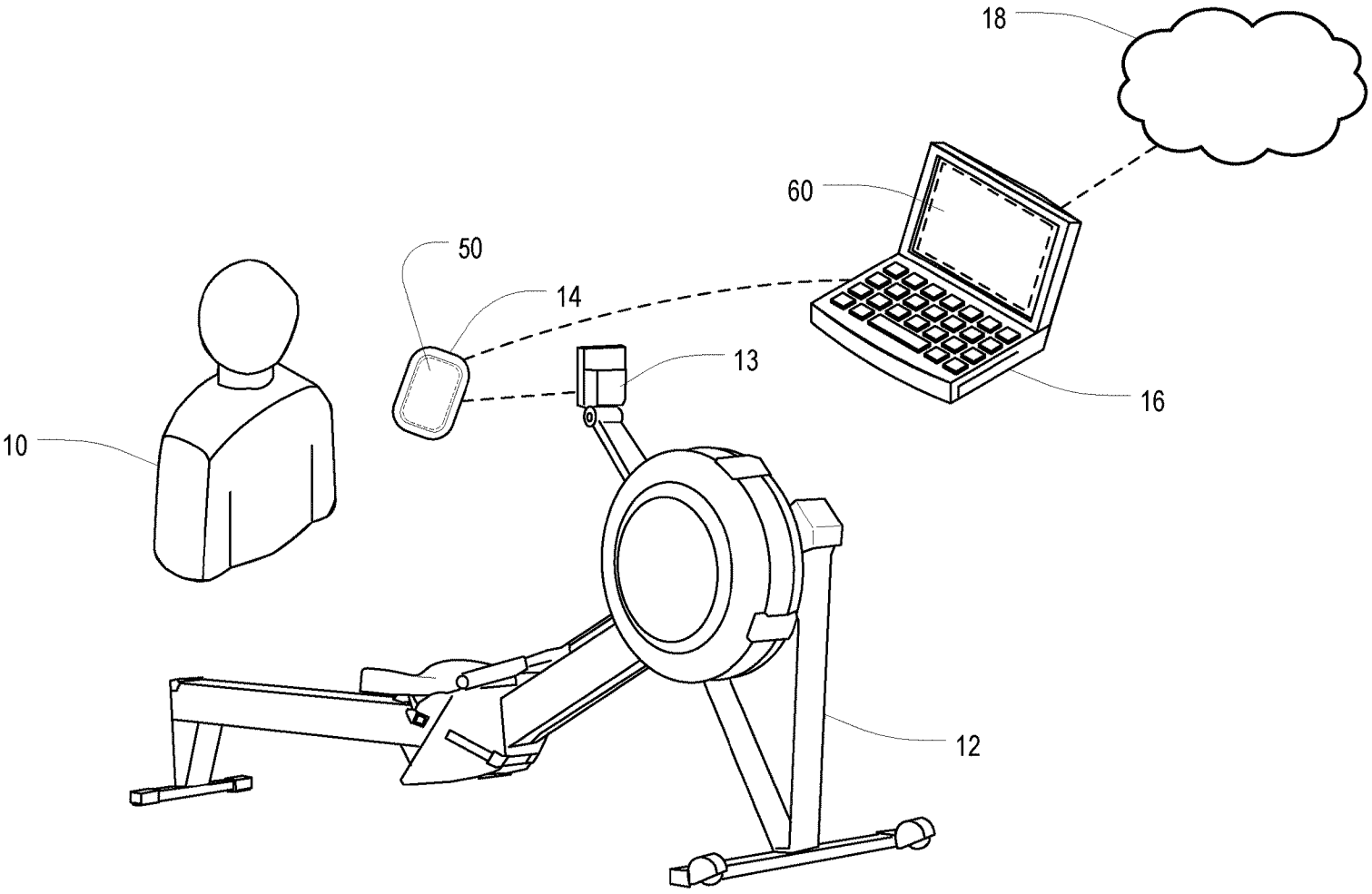
FIGS. 1A, 1B, and 1C are schematic diagrams illustrating the elements of various exercise environments involving use of a cruise control function with a training game in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Furthermore, an embodiment of the invention may incorporate only one or a plurality of the aspects of the invention disclosed herein; only one or a plurality of the features disclosed herein; or combination thereof. Moreover, many embodiments, including adaptations, variations, modifications, and equivalent arrangements, are implicitly disclosed herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention in any claim of a patent issuing here from, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Further, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

This invention offers athletes in non-hands-free sports the ability to pause their activity and go hands-free long enough to interact with trainer game applications or take care of bodily needs. It accomplishes this by implementing a cruise control which can be engaged during a workout and which will lock the output power reported by a fitness machine while the actual energy exerted by the athlete drops, possibly to zero, while they attend to manual tasks. The athlete can then resume their workout and disengage the cruise control to resume reporting their actual power output. Using cycling as an example, this allows the athlete's virtual cyclist to keep up with the peloton or other workout group while they take a break. As described below, the cruise control can be implemented as a software application, or as a hardware component attached to a fitness device, or as a hardware component separate from the fitness device which communicates with the fitness device over wired or wireless communications like USB or Bluetooth.

FIG. 1A is a schematic diagram illustrating the elements of an exercise environment involving use of a cruise control function with a training game in accordance with one or more preferred embodiments of the present invention. As shown therein, an athlete/user 10 exercises on a piece of fitness equipment. In the illustration of FIG. 1A, the fitness equipment is a rowing machine 12, but it will be appreciated that the fitness equipment may alternatively be a cycle trainer (including road cycles on stands, purpose-built cycle trainers, and the like), a treadmill (including an inclined treadmill), an elliptical machine, a stepper machine, a stair climber machine, a cross-country ski machine, a mountain climber machine, or the like. The fitness equipment 12 includes one or more sensors for measuring performance, such as wattage, and a communication interface, typically integrated into an equipment controller 13, for relaying performance data to a control device 14 implementing a cruise control software application 50. The control device 14 may be a general purpose device, such as a smartphone, or a dedicated device, such as a Raspberry Pi® in a case with a touchscreen or some physical buttons. The cruise control application 50 includes a user interface 20 (exemplary embodiments of which are described in detail below) that enables the athlete/user 10 to communicate with a computing device 16 implementing a trainer game application 60. Communication between the control device 14 and the computing device 16 may be carried out via Bluetooth or other suitable communication link. In at least some operating environments, the computing device 16 is connected to the internet 18 and the trainer game application 60 communicates with corresponding applications operated by other athletes/users on other fitness equipment (not shown). Notably, however, it is not necessary for the other athletes/users to be using a control device 14 or a cruise control application 50 in order for the athlete/user 10 of FIG. 1A to use the cruise control function.

Notably, in FIG. 1A, the performance data is relayed from the fitness equipment 12 to the control device 14 via a wireless communication link. However, in some embodiments, the control device 14 may be connected to the equipment controller 13 via a wired connection, and the performance data may be relayed from the fitness equipment 12 to the control device 14 via a wired communication link.

Figure 1B:
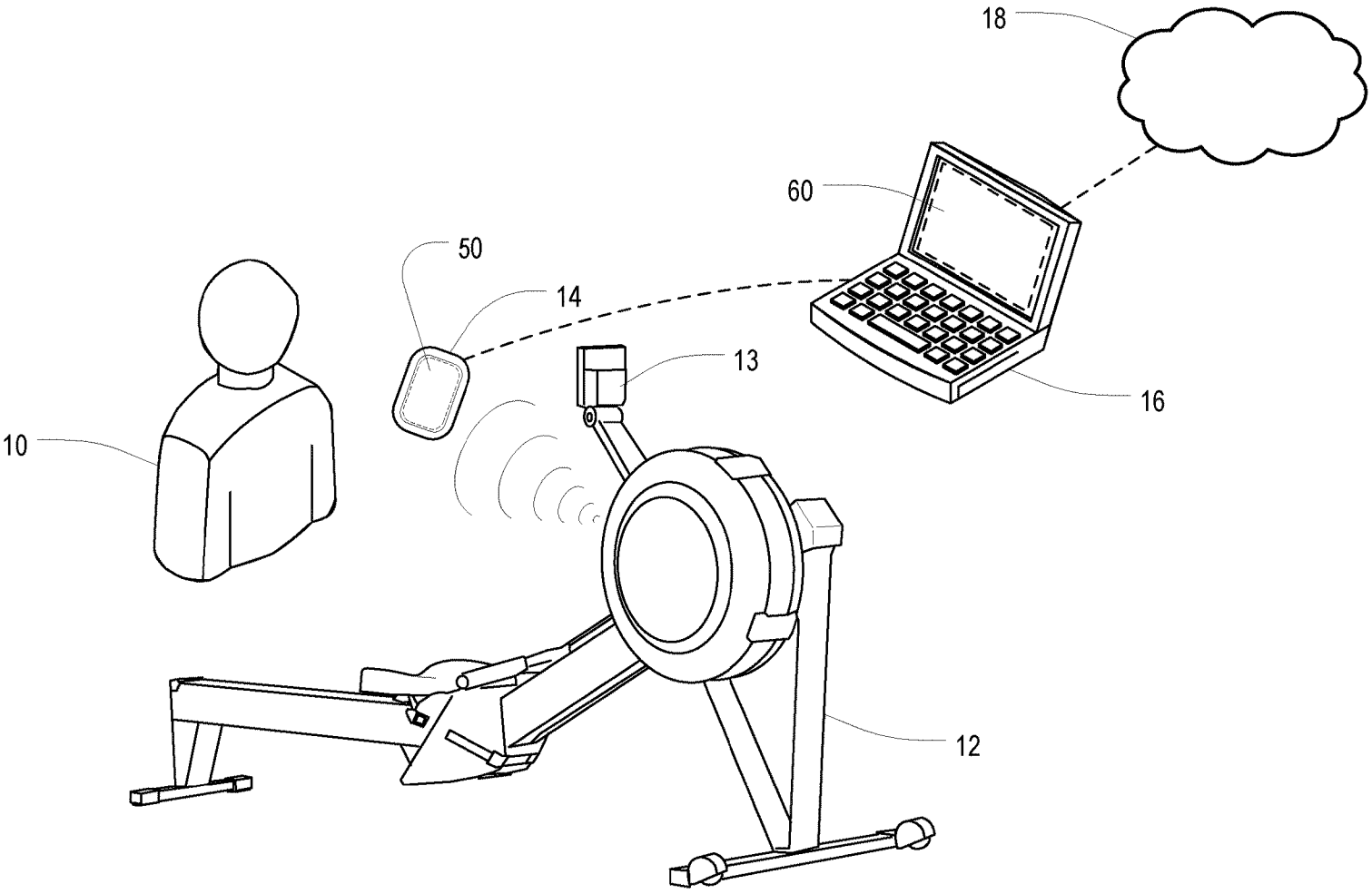
Figure 1C:
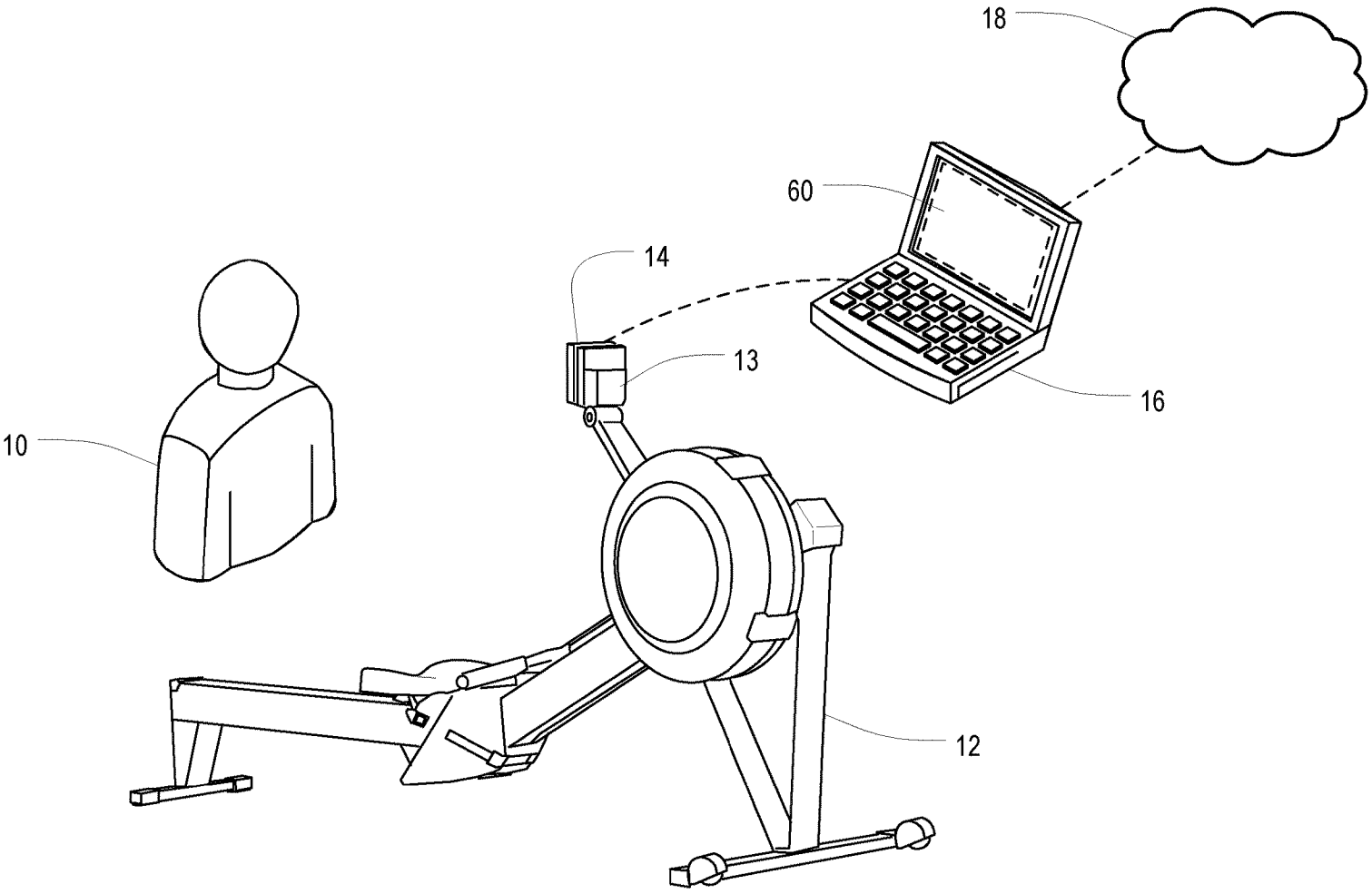
Figure 1D:
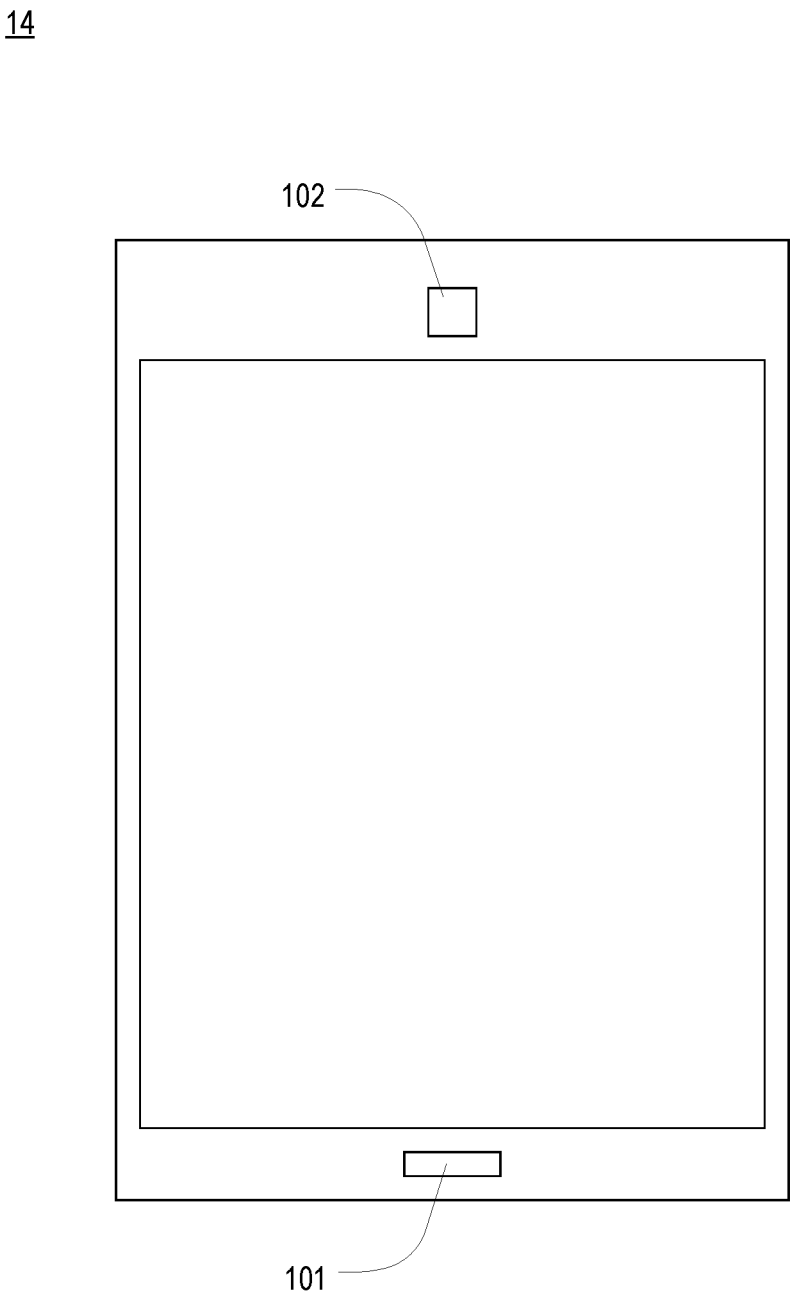
FIG. 1D is a schematic diagram of the control device showing a microphone and a camera.

Also notably, in FIG. 1A, it is assumed that the equipment controller 13 is adapted to receive performance data from one or more sensors and to transmit performance data via communication interface. However, in some embodiments, the control device 14 and/or cruise control application 50 are adapted to receive or independently develop the performance data. In this regard, FIGS. 1B and 1C are schematic diagrams illustrating the elements of alternative exercise environments involving use of a cruise control function with a training game in accordance with one or more preferred embodiments of the present invention. In FIG. 1B, the smartphone or other control device 14 includes a microphone 101 and the cruise control application 50 includes sound analysis software such that when actuated, the control device 14 and application 50 "listen" to a mechanical component of the fitness equipment 12, such as the rower flywheel, so as to determine (for example, based on the flywheel spinning up and down) the relevant performance data without communicating with the equipment controller 13 itself. In FIG. 1C, the smartphone or other control device 14 includes a camera 102 and the cruise control application 50 includes optical character recognition (OCR) software such that when actuated, the control device 14 and application 50 "watch" a numeric or alphanumeric display portion of the equipment controller 13 user interface so as to determine the relevant performance data without directly communicating with the equipment controller 13. FIG. 1D is a schematic diagram of the control device 14 showing the microphone 101 and the camera 102.

Figure 2:
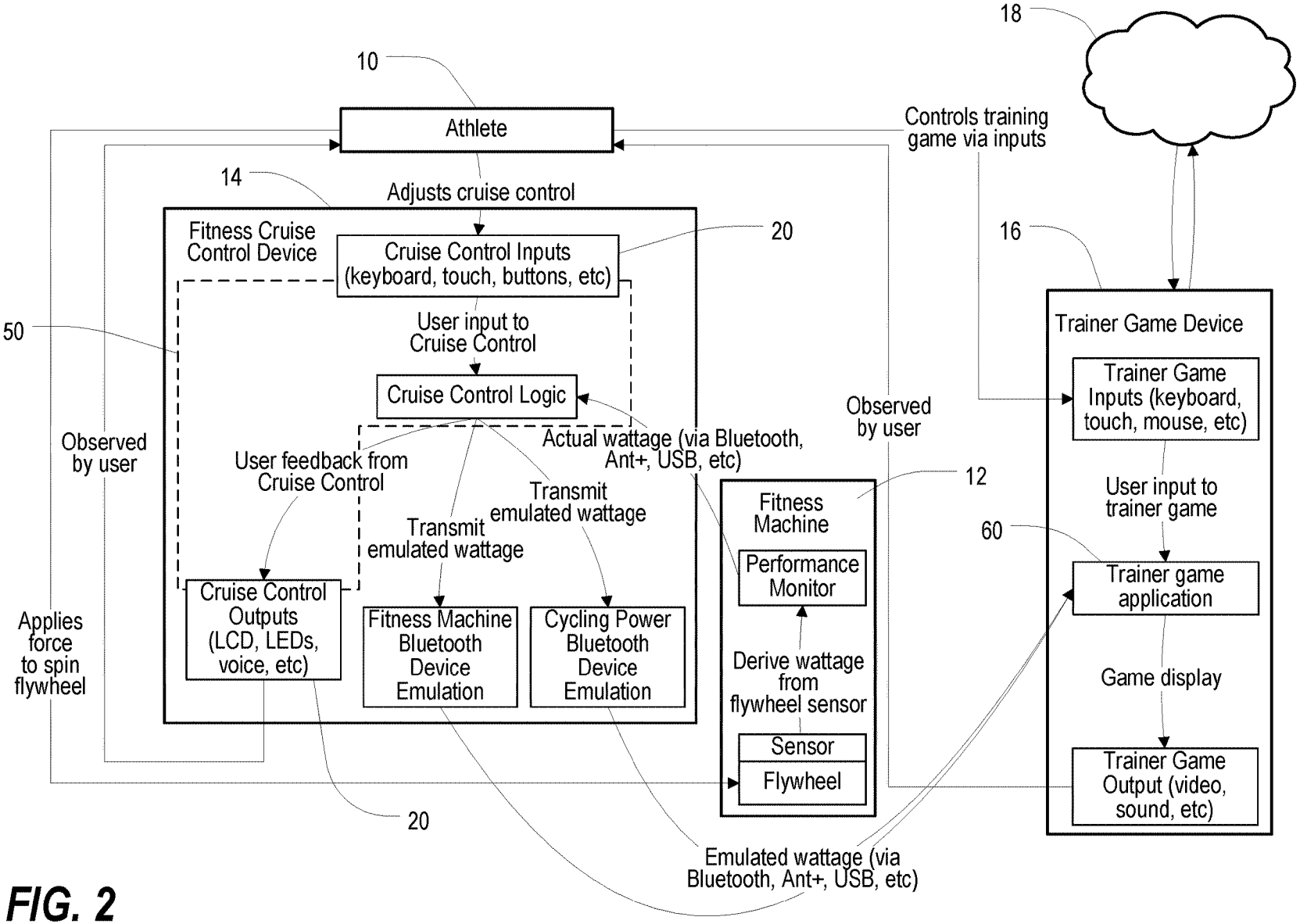
FIG. 2 is a block diagram illustrating the communications and interaction between the athlete/user, fitness equipment, control device, and trainer game device in accordance with one or more preferred embodiments of the present invention.

FIG. 2 is a block diagram illustrating the communications and interaction between the athlete/user 10, fitness equipment 12, control device 14, and trainer game device 16 of FIG. 1A in accordance with one or more preferred embodiments of the present invention. Although described with particular reference to the environment of FIG. 1A, it will be appreciated that the communications and interaction between the athlete/user 10, fitness equipment 12, control device 14, and trainer game device 16 in other environments, such as those of FIGS. 1B and 1C, are generally identical or analogous to those of FIG. 2 other than with respect to the development of the performance data. As shown in FIG. 2, the athlete/user 10 operates the fitness equipment 12 conventionally. In the case of the rowing machine, this involves applying force to the flywheel of the rowing machine. A performance monitor on the fitness machine 12 (which may be integrated into the fitness machine 12, added to the fitness machine 12 by a user, or the like) derives performance data such as wattage from the flywheel or other operational component of the machine 12. This actual wattage or other performance data is communicated to the cruise control application 50 implemented in the control device 14. The athlete/user 10 operates the control device 14 and software application 50 via the user interface 20 to engage or disengage a cruise control function as desired. The control device 14 emulates the fitness machine by providing emulated output data to the trainer game 60 on the computing device 16. The particular data provided is either actual data or cruise control system-generated data, depending on whether the cruise control function is disengaged or engaged. The athlete/user 10 otherwise interacts with the trainer game 60 conventionally, controlling it via standard inputs and watching and listening to game-generated scenes and sounds via standard displays, speakers, and other outputs.

Figure 3:
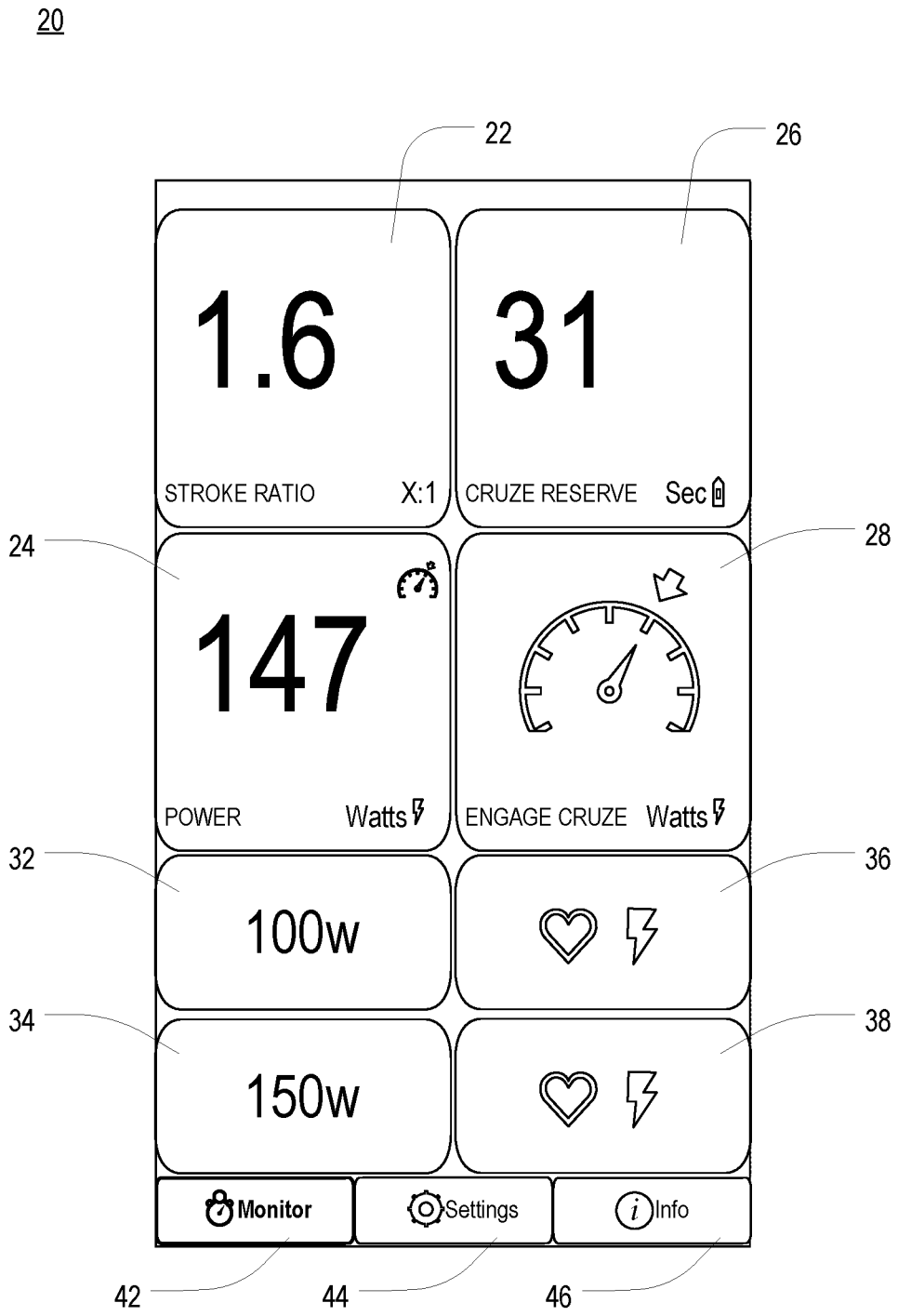
FIG. 3 is a screenshot of an exemplary user interface for a cruise control application for a rowing machine in accordance with one or more preferred embodiments of the present invention.

FIG. 3 is a screenshot of an exemplary user interface 20 for a cruise (or "cruze") control application 50 for a rowing machine 12 in accordance with one or more preferred embodiments of the present invention. In this exemplary user interface, there are four primary interface areas, a plurality of secondary interface areas, and a plurality of utility buttons. The user interface 20 provides a user 10 with information, options, and controls based at least in part on data received or derived from the fitness machine 12, which in this case is a rowing machine. In at least some embodiments, the primary interface areas 22,24,26,28 are larger than the secondary interface areas, and the secondary interface areas 32,34,36,38 are larger than the utility buttons 42,44,46. In some contemplated commercial embodiments, the primary interface areas 32,34,36,38 have a blue background, the secondary interface areas 32,34,36,38 have a grey background, and the utility buttons 42,44,46 have a white background, but other colors and designs are likewise contemplated without departing from the scope of the present invention.

For a control device 14 having a rectangular display, the user interface 20 may be presented in a horizontal (landscape) mode, in a vertical (portrait) mode, or in a horizontal (landscape) mode or vertical (portrait) mode depending on the orientation of the device 14. In some embodiments, the utility buttons are presented along the bottom of the user interface 20 in both horizontal (landscape) mode and vertical (portrait) mode, while in other embodiments, the utility buttons 42,44,46 are presented along the left end of the user interface 20 in horizontal (landscape) mode and at the top of the user interface 20 in vertical (portrait) mode.

It will be appreciated that the particular user interface 20 provided may be specifically designed to correspond to the particular fitness equipment 12 with which it is utilized. In some embodiments, a particular application 50 is provided that corresponds to the particular fitness equipment 12 being used. In other embodiments, a single application 50 is provided but which includes selectable or customizable portions such that a user 10 may customize the user interface 20 based on the fitness equipment 12 with which it is being used. In the description and accompanying illustrations that follow, the user interface 20 is adapted for use with a rowing machine 12, but it will be appreciated that various aspects of the interface 20 may thus be varied without departing from the scope of the present invention.

In the illustrated user interface 20, a first primary interface area 22 displays the user's current stroke ratio, wherein "stroke ratio" refers to the ratio between recovery and drive in a rowing stroke cycle. This area 22 is labeled "STROKE RATIO" in the exemplary user interface 20. A second primary interface area 24 displays the current workout power (measured instantaneously, averaged over a short duration, or the like) for the user 10 on the fitness machine 12. This area 24 is labeled "POWER" in the exemplary user interface 20. Although shown here in watts, it may additionally or alternatively be displayed using different units, and/or the UI may permit a user to select the units in which power is displayed. A third primary interface area 26 displays the current cruise control reserve power ("cruise reserve"). This area 26 is labeled "CRUZE RESERVE" in the exemplary user interface 20. A fourth primary interface area 28 displays information, data, or the like pertaining to the engagement status of the cruise control function. In FIG. 3, it is shown in a disengaged state and is labeled "ENGAGE CRUZE;" in at least some embodiments, this interface area 28 functions as a selectable button which, if clicked, engages the cruise control as further described elsewhere herein.

The secondary interface areas 32,34,36,38 are presented in the middle of the user interface 20, below the primary interface areas, in vertical (portrait) mode, as shown in FIG. 3, and along the right end of the user interface 20 in horizontal (landscape) mode. The secondary interface areas 32,34,36,38 are selectable buttons corresponding to various respective preset workout power values. Their values may be preset to application defaults, to values derived from previous workouts, to values input by a user, or to values determined in other ways. Four selectable buttons are shown in FIG. 3 (and subsequent screenshots of the exemplary user interface 20) but it will be appreciated that the number of such buttons may vary. Furthermore, it will be appreciated that in some embodiments, a single secondary interface area (not shown) or a utility button (not shown) may be used to access a plurality of different preset values, to access a user interface input element that permits direct or semi-direct entry of a value, or to access other functions related to the input of workout power values, all without departing from the scope of the present invention.

In operation, a user may use the cruise control functionality to replace the actual output signal from the rowing machine 12 or other fitness machine with a virtual output signal. The cruise control functionality may provide one or more different modes of operation. For example, in a first alternative mode of operation, the actual output signal from the rowing machine 12 is replaced with the virtual output signal for an indefinite period of time. In a second alternative mode of operation, the actual output signal from the rowing machine 12 may only be replaced with the virtual output signal for a period of time, and/or at a particular rate, based on the accumulation of previous effort by the user. Other, more sophisticated modes of operation may additionally or alternatively be provided.

Figure 4A:
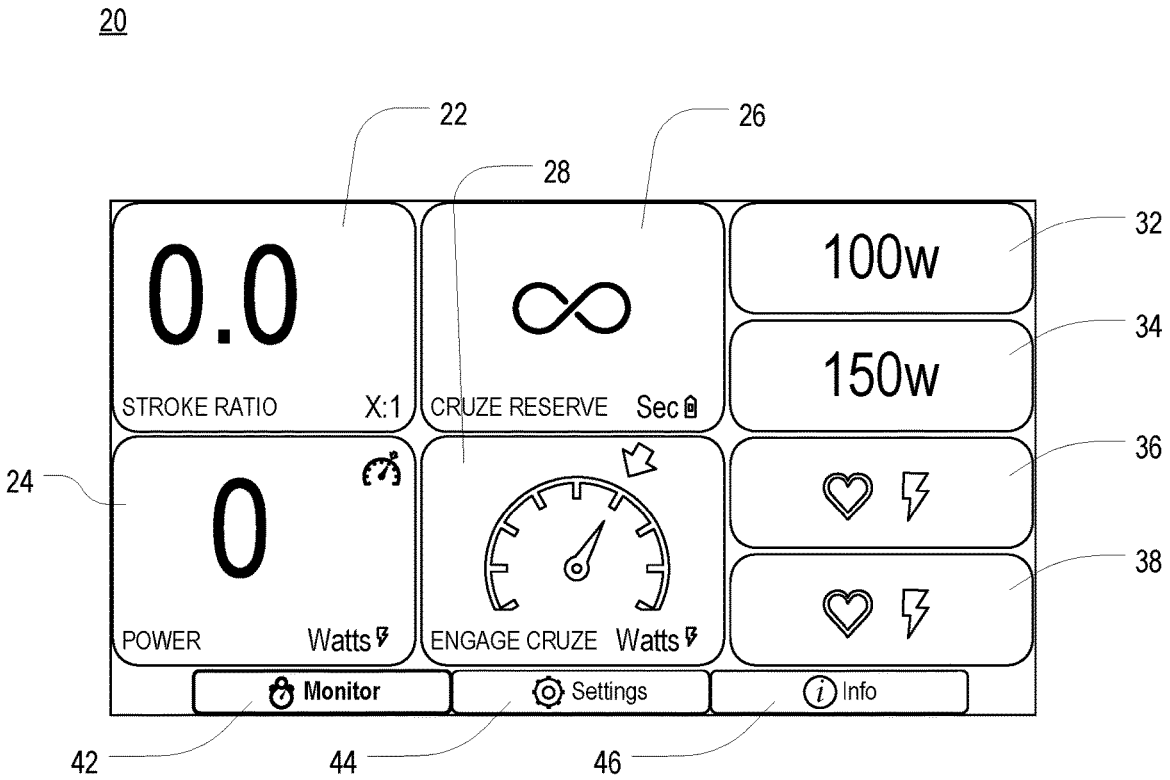
FIGS. 4A-4G are screenshots of the exemplary user interface of FIG. 3 illustrating a first alternative mode of operation of the cruise control application of FIGS. 1A and 2.
Figure 4B:
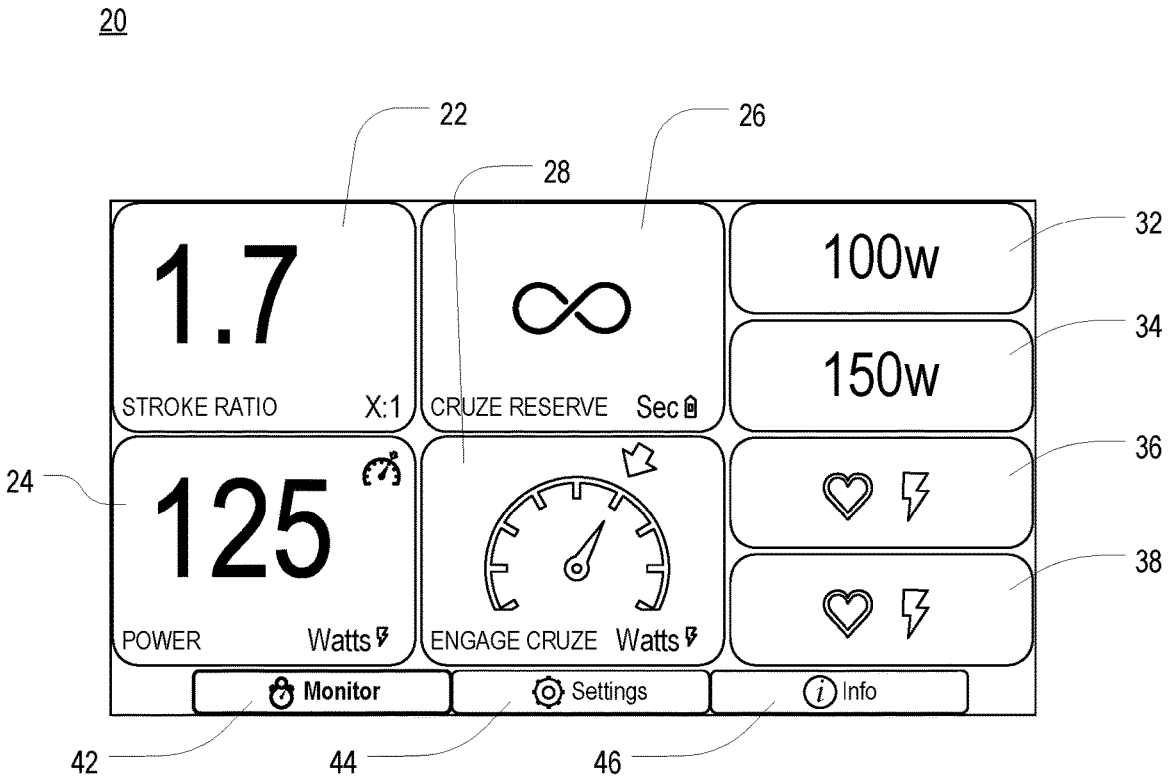
Figure 4C:
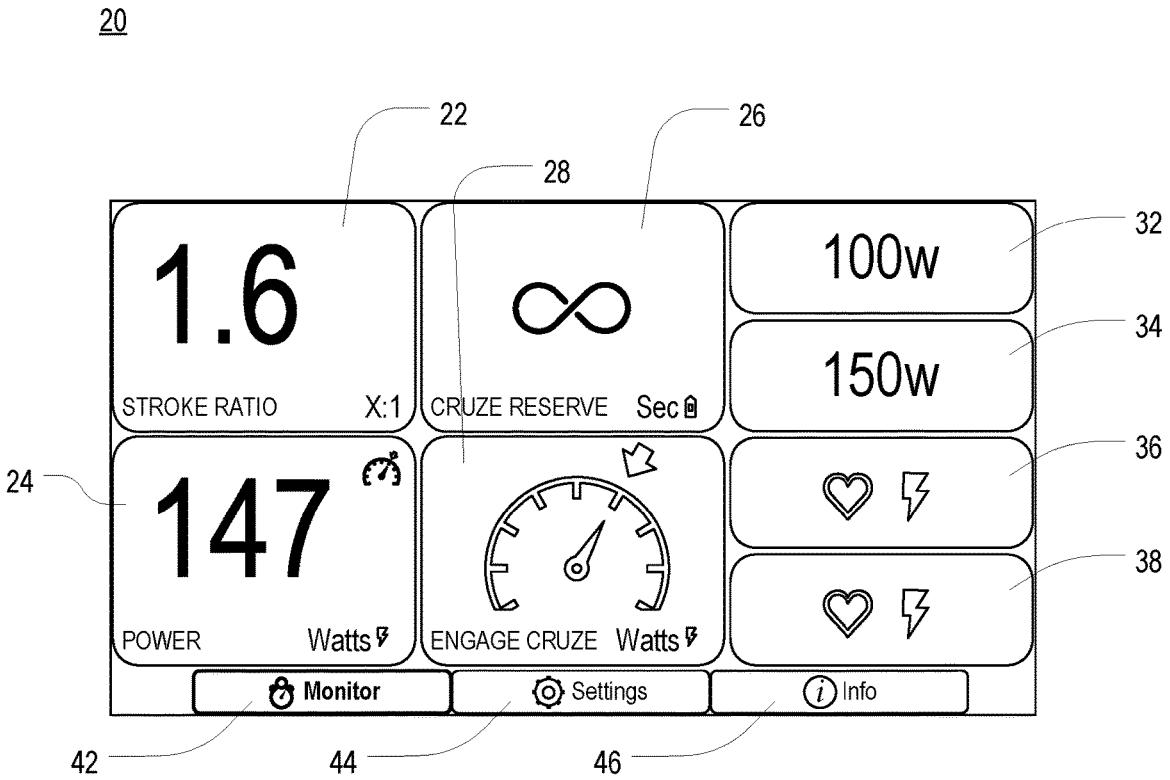
Figure 4D:
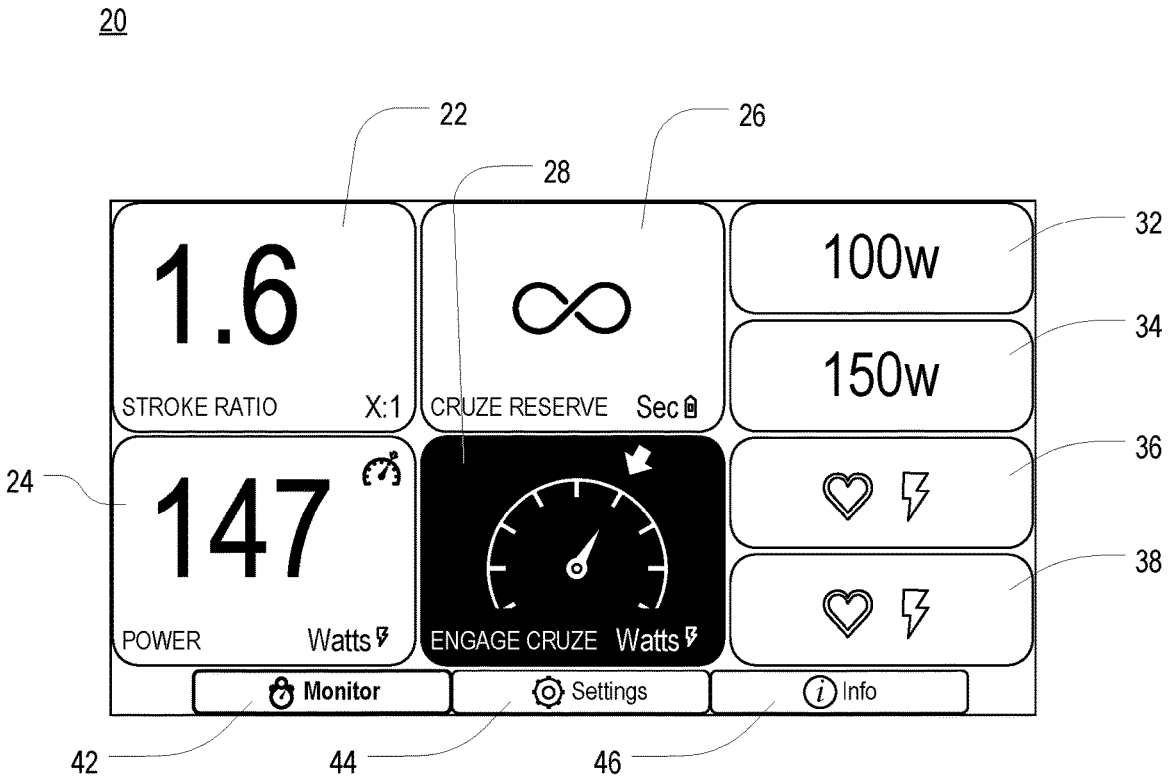
Figure 4E:
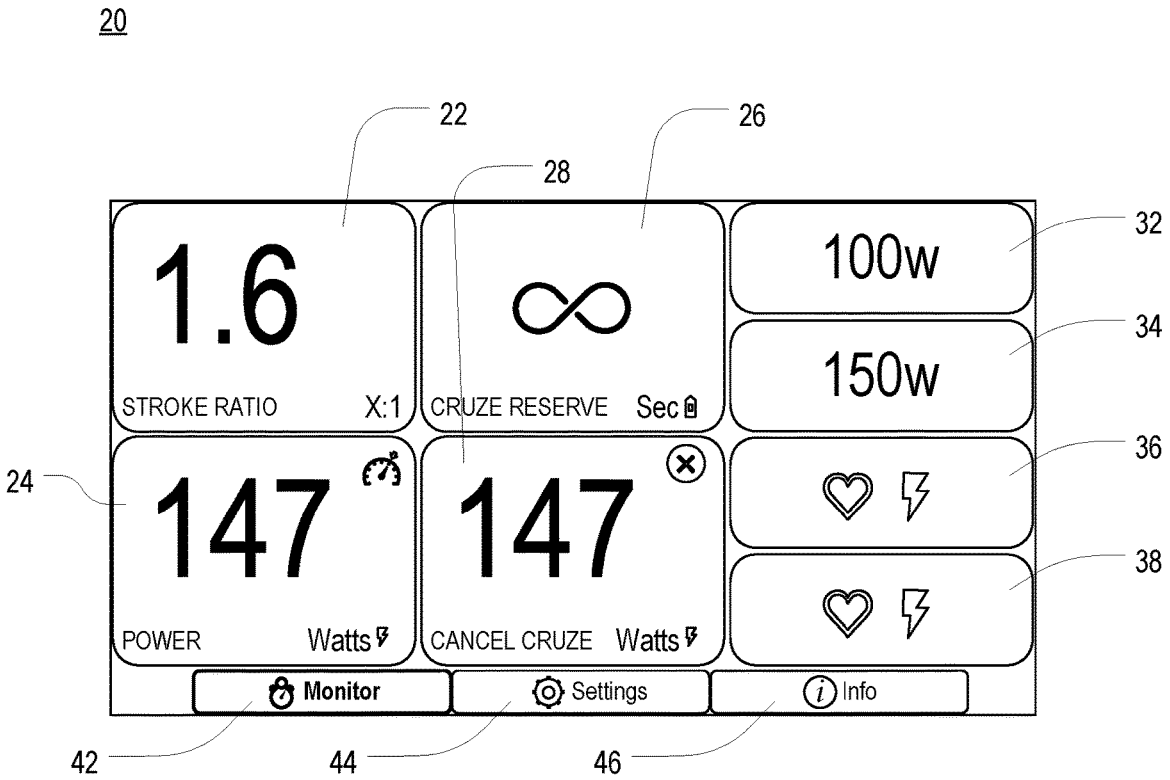
Figure 4F:
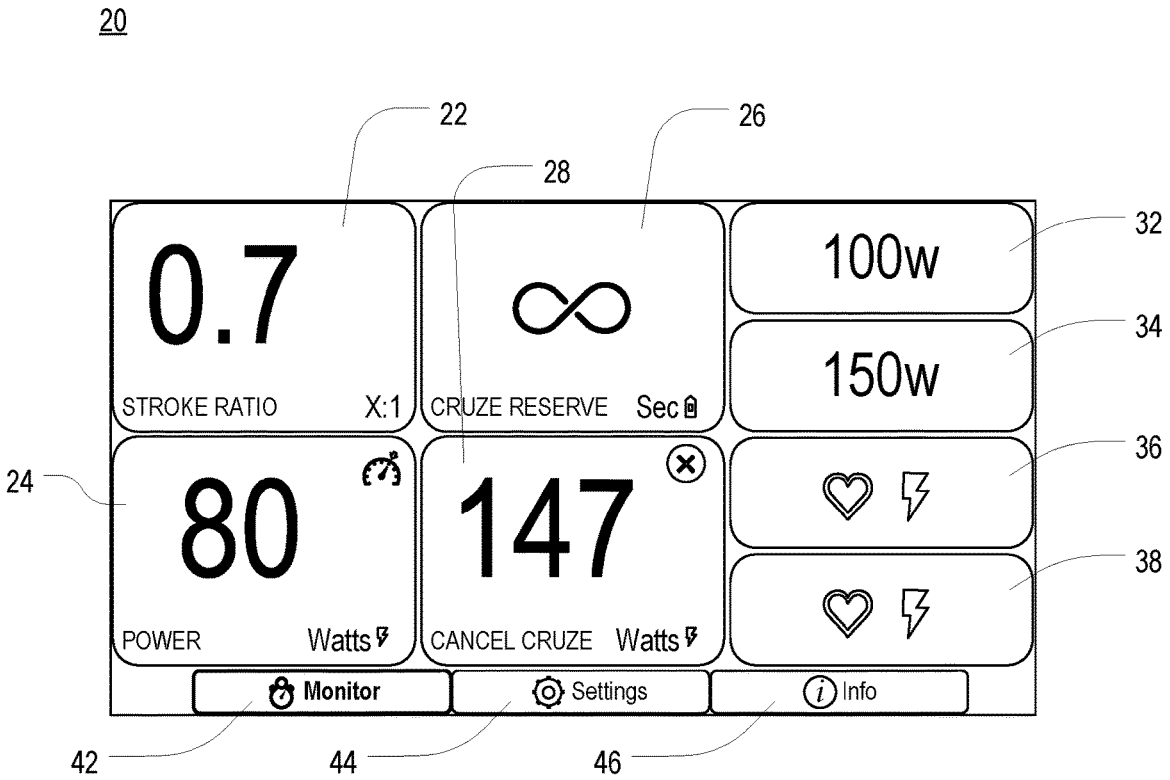
Figure 4G:
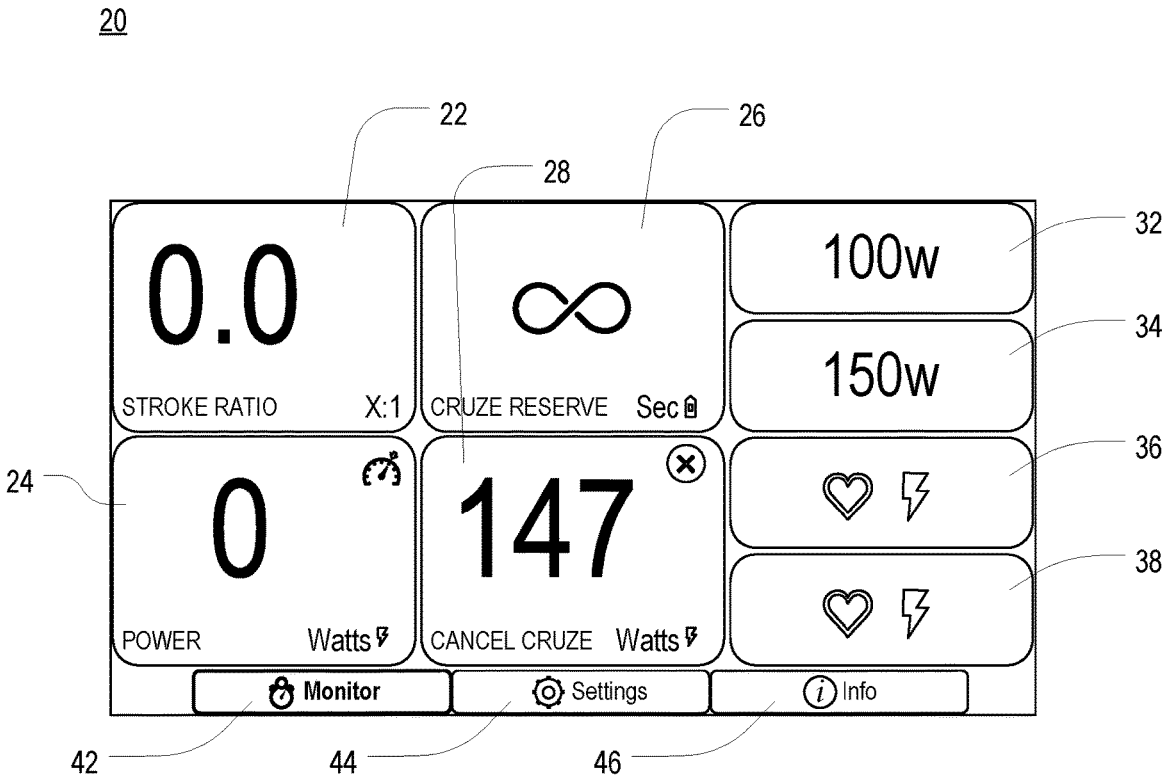

The first alternative mode of operation is illustrated in FIGS. 4A-4G. FIG. 4A shows the user interface 20 of the cruise control application 50 (presented in a horizontal (landscape) mode) prior to the start of at the beginning of a workout. Because the workout has not yet begun, the stroke ratio remains at 0.0 to 1, the current power is 0 watts, and the cruise control is shown in the disengaged state. Also, because in this mode of operation there is no limit on how long the cruise control function may be used, an "infinity" symbol (∞) is shown for the current cruise control reserve power. In FIG. 4B, a workout has begun. The current stroke ratio is shown as 1.7 to 1, and the current power is 125 watts. The cruise control function itself, however, is still not engaged, and thus the power value that is output by the cruise control application 50 (and transmitted by the control device 14) is the actual power produced by the user, which here is 125 watts. In FIG. 4C, the workout has progressed further. The current stroke ratio is slightly lower at 1.6 to 1, while the current power is up to 147 watts. However, because the cruise control is still not engaged, the actual power produced by the user (now 147 watts) is still the power value that is output by the control device 14. At this point, however, the user engages the cruise control. This may be accomplished, for example, by "clicking" the fourth primary interface area 28 as shown in FIG. 4D. As shown in FIG. 4E, the fourth primary interface area 28 then changes to show the cruise control set-point, and the fourth primary interface area 28 is relabeled "CANCEL CRUZE" and displays a cancel (X) icon to help the user understand that tapping it again will disengage the cruise control function and return to reporting actual workout power to the training game.

In at least some embodiments, the cruise control set-point utilized when the cruise control function is engaged in this manner is the value of the actual power being produced by the user at the time the button 28 is clicked. More particularly, because the actual power at the moment the user clicked the fourth primary interface area 28 was 147 watts, the cruise control set-point is established as 147 watts, as shown in FIG. 4E. The value of the cruise control set-point (147 watts) is then output from the cruise control application 50 to the trainer game 60 regardless of whether the user continues to exercise on the rowing machine 12 or not. For example, in FIG. 4F, the user's actual power has diminished to 80 watts at a stroke ratio of 0.7 to 1, while in FIG. 4G, both the actual power and the stroke ratio have dropped to zero, but the power value provided by the cruise control application 50 to the trainer game 60 continues to hold steady at 147 watts. The user may then disengage the cruise control whenever desired by clicking the fourth primary interface area 28 again.

Preferably, a second mode of operation is also provided wherein the cruise control function is available only after the user first accumulates a "power reserve" (i.e., the cruise reserve). By way of background, it will be understood that the integrity of trainer games depends, in part, on accurate measurement of athletic performance, especially power output, and that athletes themselves want to track their workout power output accurately. The cruise control function introduces error into this process by essentially creating "free" power when it is engaged and the athlete has paused their efforts. The cruise reserve mitigates this problem by permitting a user 10 to store excess power that is produced while the cruise control is engaged. An example of this approach is explained as follows. 1) A rowing athlete engages the cruise control at a certain power level, say 100 watts. 2) The athlete continues rowing but increases their power output to 200 watts. 3) The cruise control continues to report 100 watts of power to the trainer game 60, and begins tracking the excess power as watt-seconds in the cruise reserve, which it displays for the athlete 10 to track. 4) If the athlete 10 then stops rowing, for example in order to get a drink or do another manual activity, the cruise control application 50 continues reporting 100 watts of output power to the training game 60 and begins subtracting equivalent watt-seconds from the reserve. 5) If the cruise reserve runs out, the cruise control shifts over to reporting the athlete's actual power output, which may be zero, until their output rises above the cruise control set-point again. In this way, the cruise control allows the athlete to "bank" power in advance of taking a break which in turn allows them to maintain workout accuracy in terms of energy expenditure.

Figure 5:
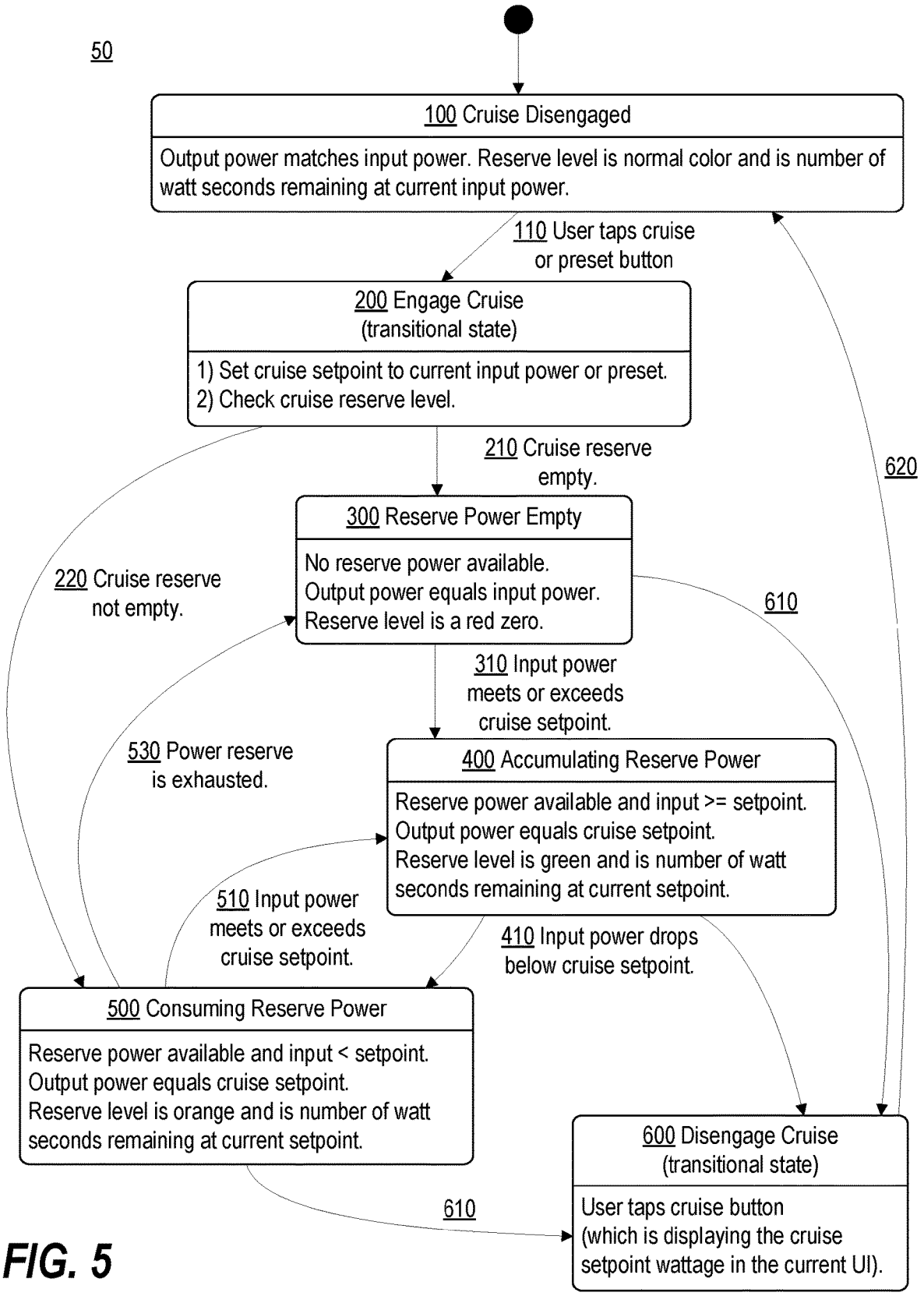
FIG. 5 is an exemplary state diagram illustrating a second alternative mode of operation of the cruise control application of FIGS. 1A and 2.

FIG. 5 is an exemplary state diagram illustrating the second alternative mode of operation of the cruise control application 50 of FIGS. 1A and 2. In a first state 100, the cruise control function is disengaged, and the power value that is output by the application 50 is the actual power being generated by the user. If the user engages the cruise control function at condition 110, then a cruise control function is engaged at transitional state 200, with the cruise control set-point being dependent on how the function is engaged, and further functionality is dependent on whether there is any cruise reserve available. If at condition 220 the cruise reserve is not empty (i.e., there is cruise reserve available), then at state 500, the cruise reserve is consumed. On the other hand, if at condition 210 the cruise reserve is empty, then a reserve power empty state 300 is entered, and the power value that is output by the application 50 is the actual power being generated by the user.

If the actual power being produced meets or exceeds the current cruise control set-point at condition 510 (while in the "consuming reserve power" state 500) or at condition 310 (while in the "reserve power empty" state 300), then the application 50 begins accumulating reserve power at state 400. The application 50 remains in this state 400 until the actual power being produced drops below the cruise control set-point at condition 410, at which point the cruise reserve power is consumed again at state 500. If the cruise reserve power is fully consumed at condition 530, then the "reserve power empty" state 300 is entered once again.

While the cruise control function is engaged, any of cruise operational states 300,400,500 are terminated immediately if the user 10 manually disengages the cruise control function at transitional state 600. This may be accomplished, for example, by tapping the "CANCEL CRUZE" button 28 on the user interface 20. Operation then returns to the initial state 100.

Figure 6A:
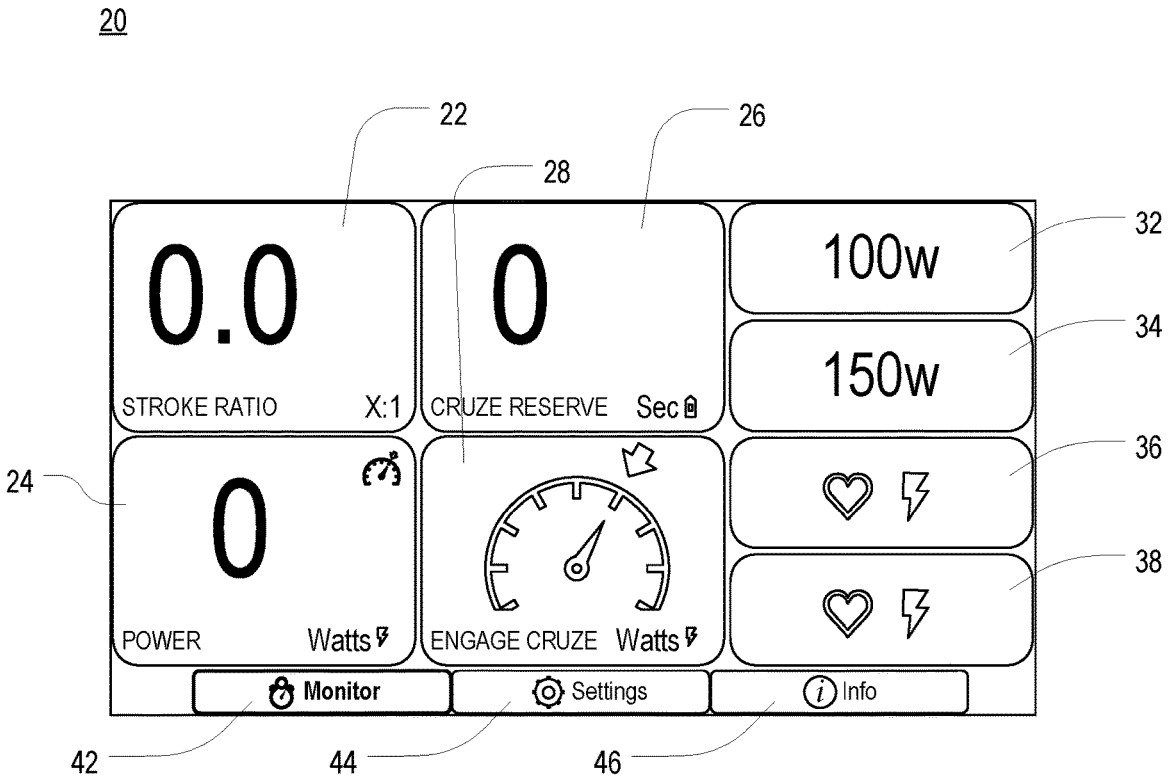
FIGS. 6A-6F are screenshots of the exemplary user interface of FIG. 3 illustrating the second alternative mode of operation.
Figure 6B:
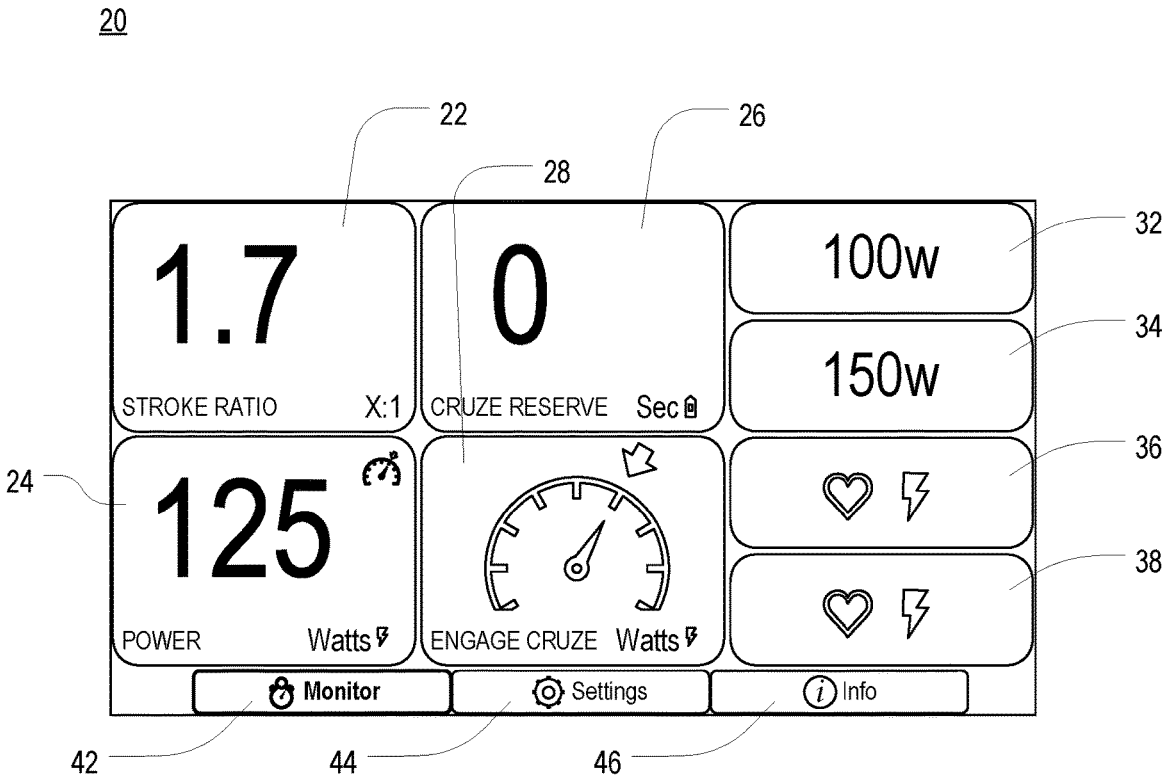
Figure 6C:
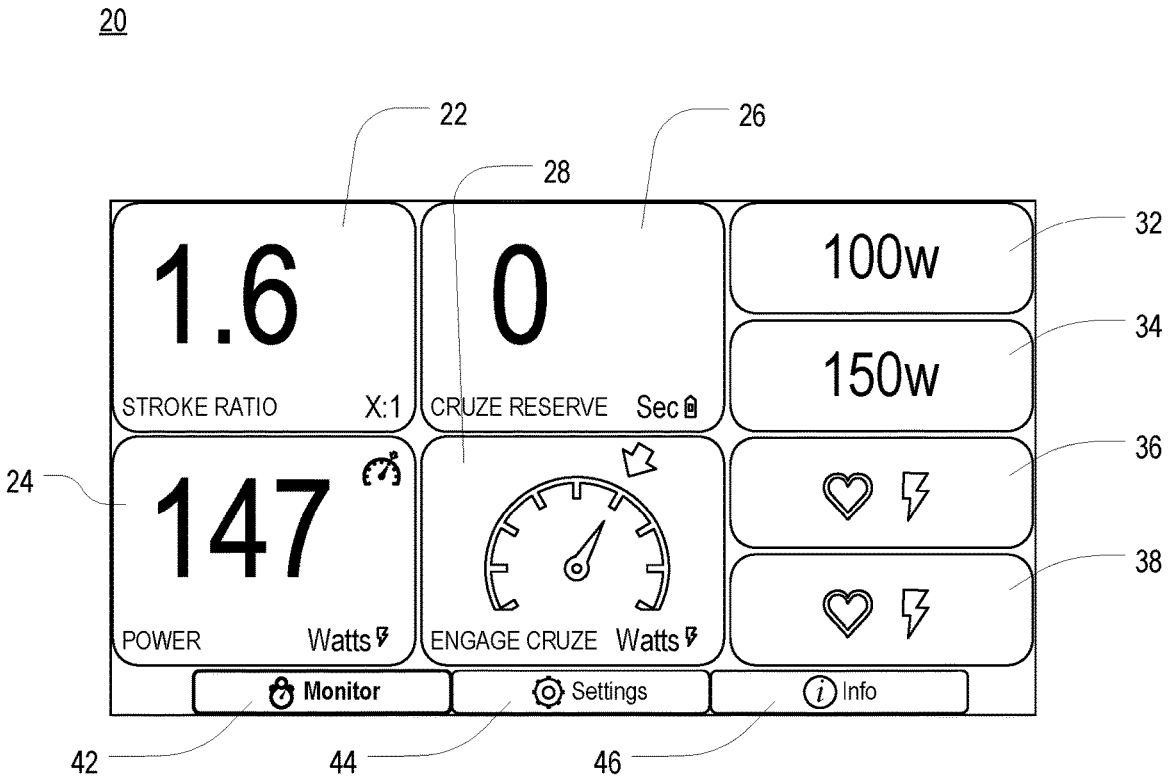
Figure 6D:
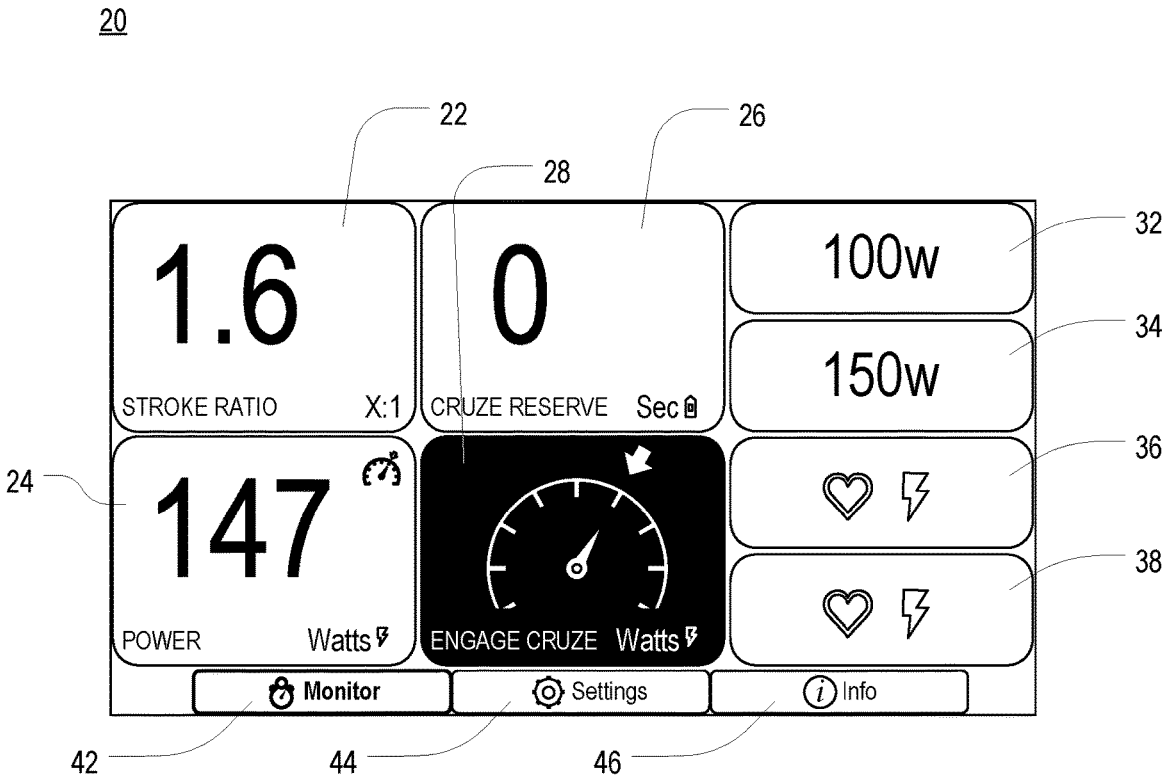
Figure 6E:
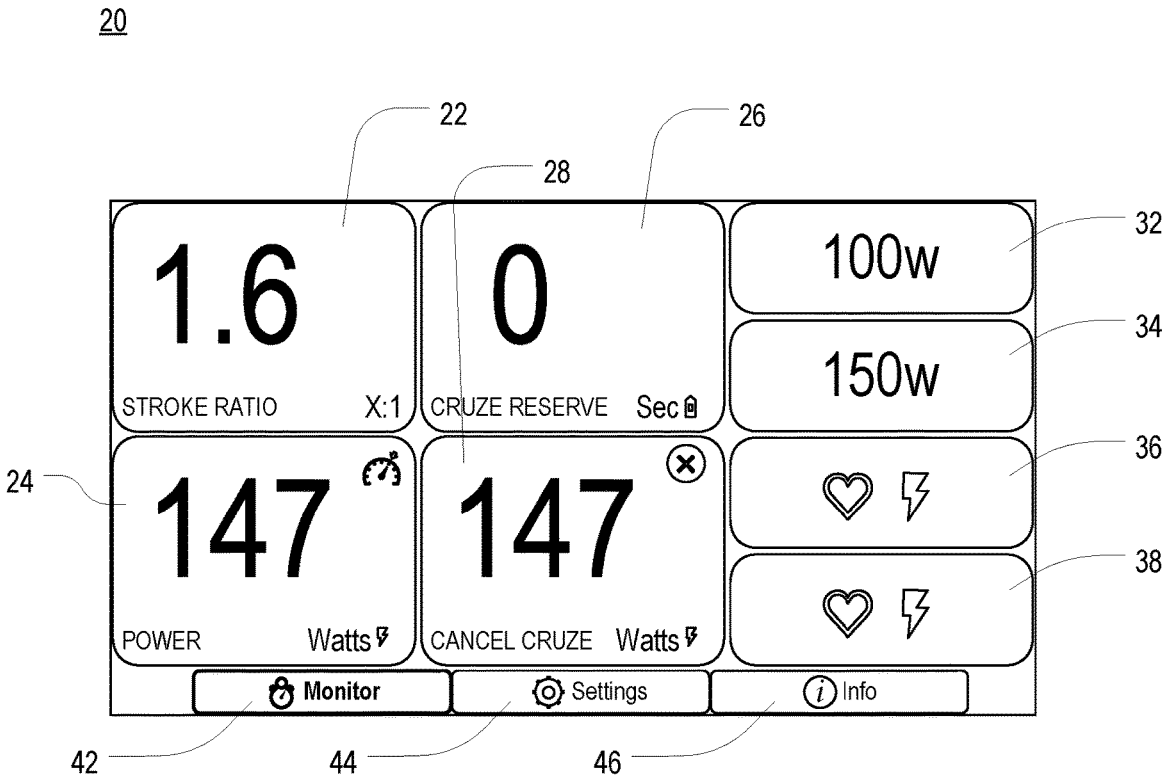

This functionality is illustrated beginning in FIG. 6A, which shows the user interface 20 of the cruise control application 50 prior to the start of at the beginning of a workout. Because the workout has not yet begun, the stroke ratio remains at 0.0 to 1, the current power is 0 watts, and the cruise control is shown in the disengaged state. Also, because in this mode of operation the cruise control function may only be utilized so long as cruise reserve has been accumulated, the current cruise control reserve power is shown at 0 seconds. In FIG. 6B, a workout has begun. The current stroke ratio is shown as 1.7 to 1, and the current power is 125 watts. The cruise control function itself, however, is still not engaged, and thus the power value that is output by the control device 14 and cruise control application 50 is the actual power produced by the user 10, which here is 125 watts. In FIG. 6C, the workout has progressed further. The current stroke ratio is slightly lower at 1.6 to 1, while the current power is up to 147 watts. However, because the cruise control is still not engaged, the actual power produced by the user (now 147 watts) is still the power value that is output by the device 14. At this point, however, the user engages the cruise control. This may be accomplished, for example, by "clicking" the fourth primary interface area 28 as shown in FIG. 6D. As shown in FIG. 6E, the fourth primary interface area 28 then changes to show the cruise control set-point, and the fourth primary interface area 28 is relabeled "CANCEL CRUZE" and displays a cancel (X) icon to help the user understand that tapping it again will disengage the cruise control function and return to reporting actual workout power to the trainer game.

Figure 6F:
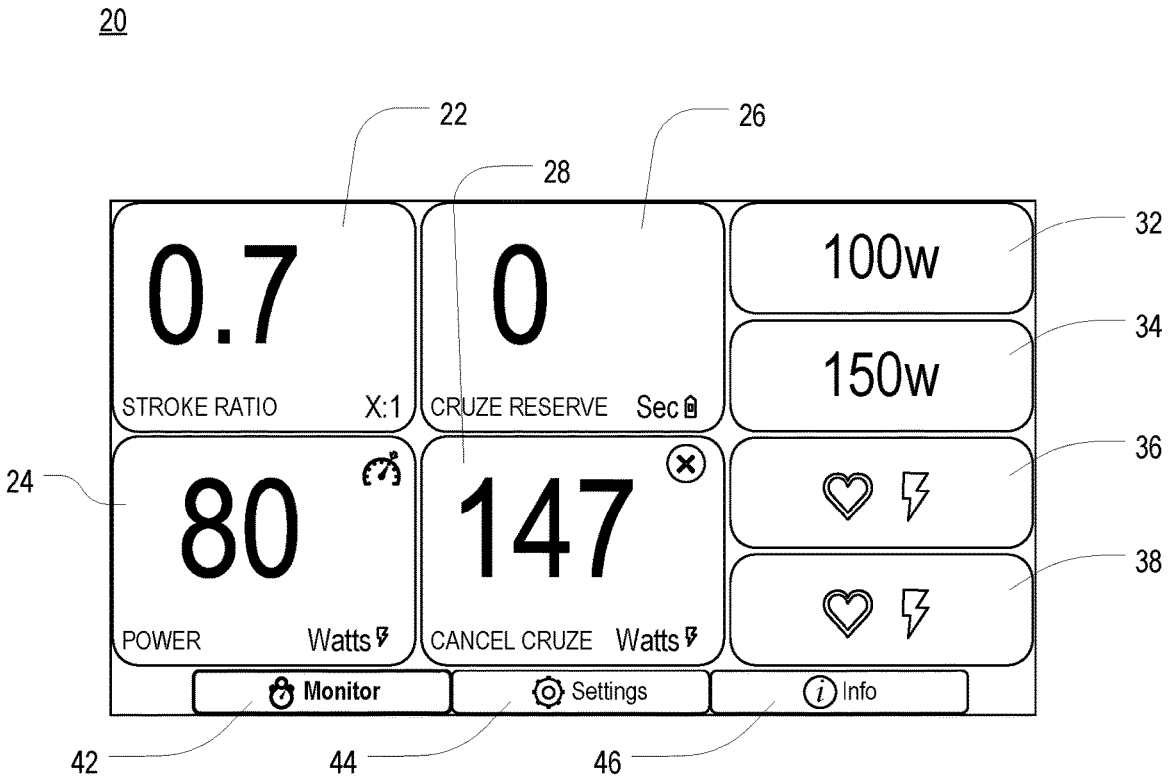

To this point, the second mode of operation is similar to the first mode of operation. However, in the second mode of operation, the power value that is output by the cruise control application 50, and reported to the trainer game 60, depends on whether the user has accumulated any cruise reserve, as shown in the third primary interface area 26. In the scenario described thus far, the user has not yet accumulated any cruise reserve (i.e., the cruise reserve is 0), and thus the actual power produced by the user (147 watts) continues to be output by the application 50. Furthermore, if the user's actual power drops below the cruise control set-point of 147 watts when the user has no cruise reserve, as shown in FIG. 6F, then the actual power will continue to be output even though the cruise control has been engaged.

Figure 7A:
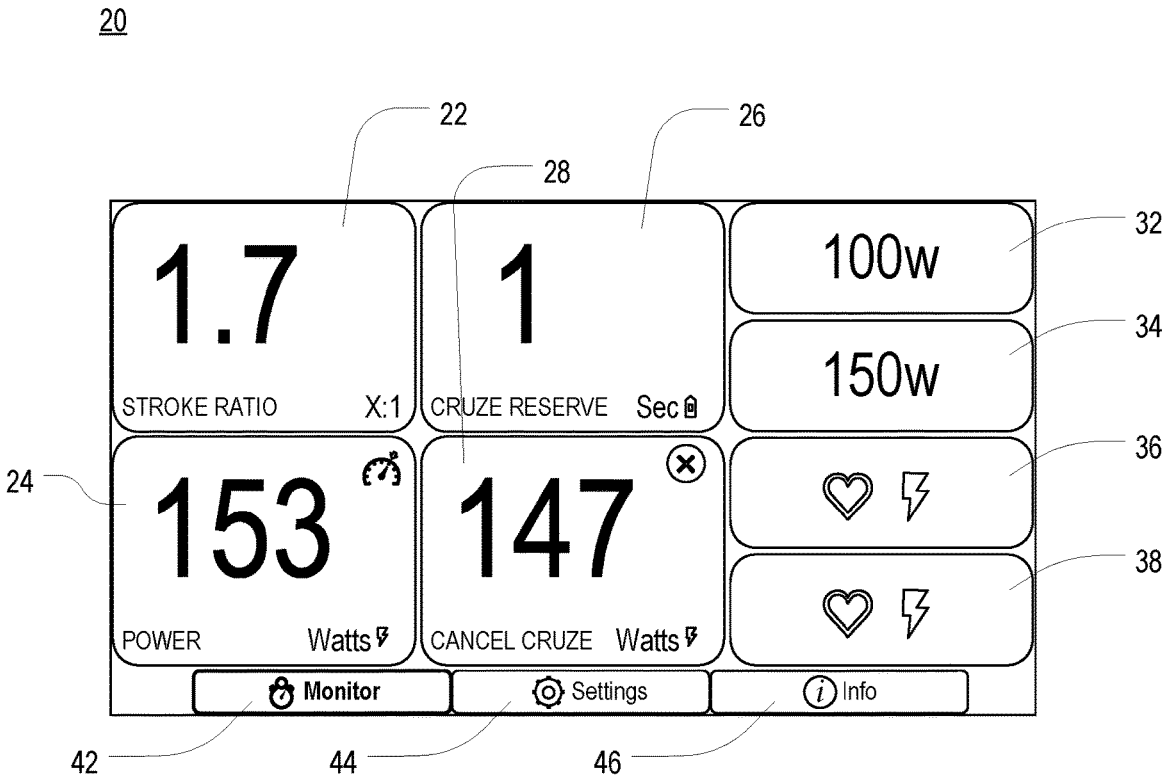
FIGS. 7A-7C are screenshots of the exemplary user interface of FIG. 3 further illustrating the second alternative mode of operation.
Figure 7B:
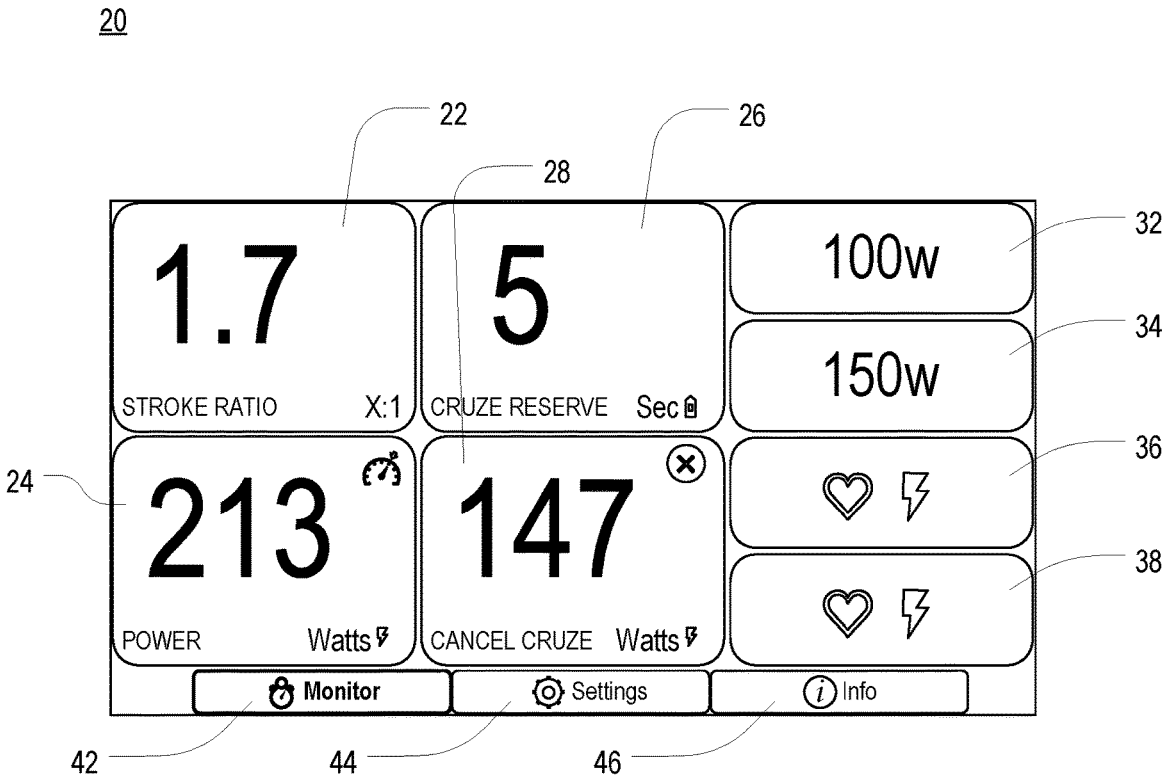
Figure 7C:
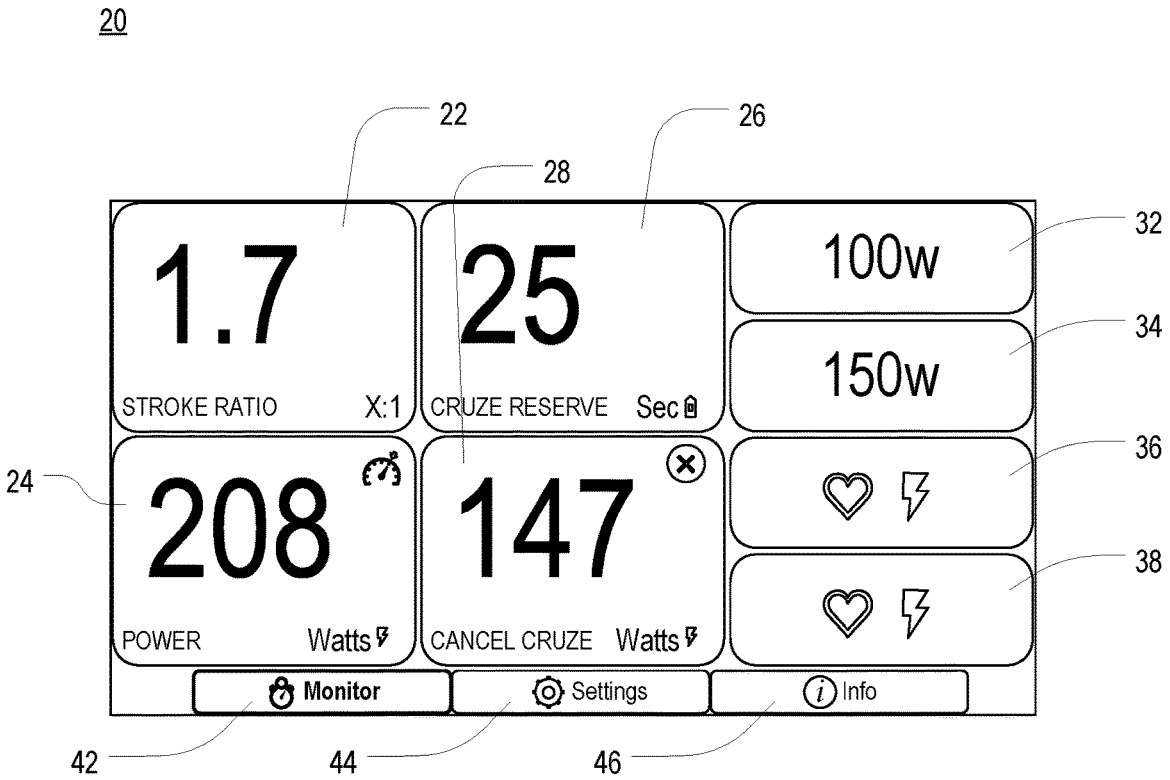

In the second mode of operation, a virtual power value will only be output if a nonzero amount of cruise reserve is available. Thus, before the cruise control function may be utilized, the user must first accumulate cruise reserve as shown in FIGS. 7A-7C. FIG. 7A illustrates the state of the user interface 20 immediately after engaging the cruise control. The user has increased his or her power output to 153 watts, which is greater than the cruise control set-point (147 watts). In the second mode of operation, this has two effects. First, the power value that is output from the cruise control application 50 is the value of the cruise control set-point, or 147 watts. Second, the user begins accumulating cruise reserve. In FIG. 7A, the user has already accumulated a small amount of cruise reserve (1 second at 147 watts). In FIG. 7B, the workout has progressed further. The current stroke ratio is still shown as 1.7 to 1, and the current power is 213 watts. Because the user's power output (213 watts) is well above the cruise control set-point (147 watts), the reported power value provided by the cruise control application 50 is still 147 watts, the user 10 has continued to accumulate cruise reserve (now up to 5 seconds' worth) and is now doing so at a faster rate. In FIG. 7C, the user's current power has decreased slightly, but a substantial amount (25 seconds) of cruise reserve has now been accumulated. Notably, the cruise reserve is displayed in units of time (seconds), the amount of cruise reserve that has been accumulated is measured internally in watt-seconds, with the amount that is displayed being equal to the number of seconds of reserve (25) available at the current cruise control set-point (147). Thus, in FIG. 7C, the amount of cruise reserve that has been accumulated is equal to 25 seconds× 147 watts=3650 watt-seconds, which is good for a pause of 25 seconds while continuing to report a power value of 147 watts to the trainer game 60.

Figure 8A:
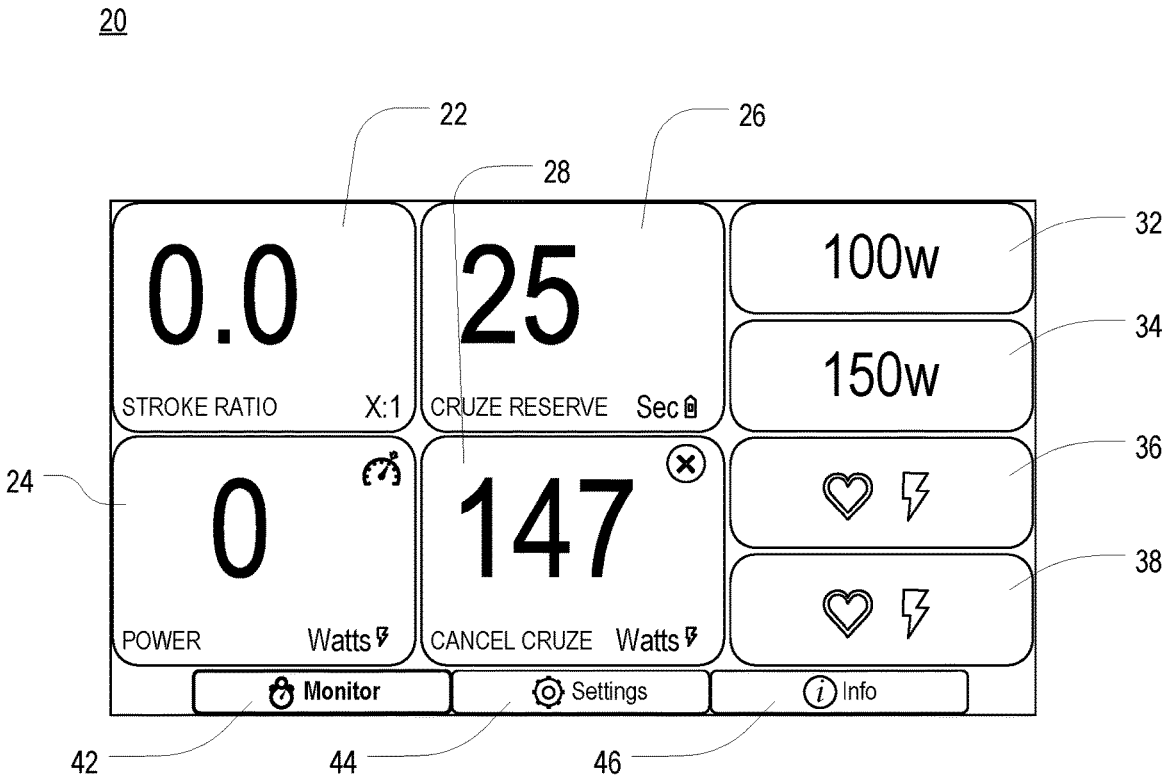
FIGS. 8A-8E are screenshots of the exemplary user interface of FIG. 3 further illustrating the second alternative mode of operation.
Figure 8B:
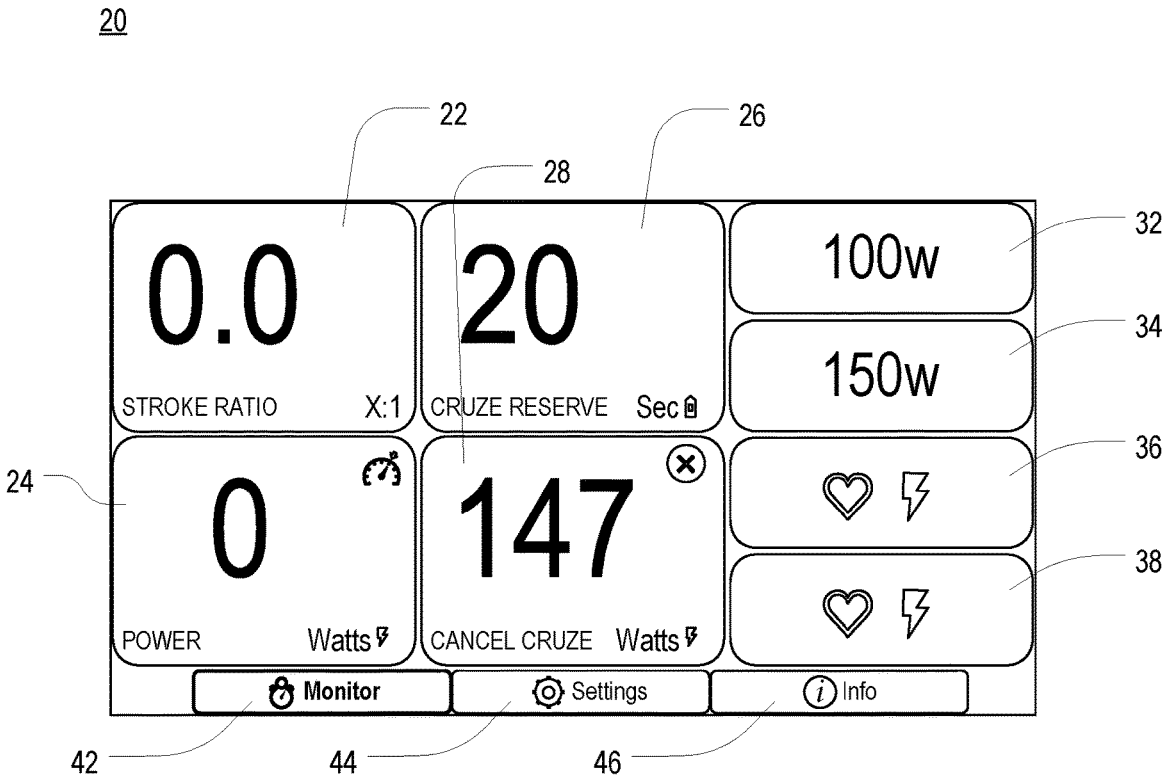
Figure 8C:
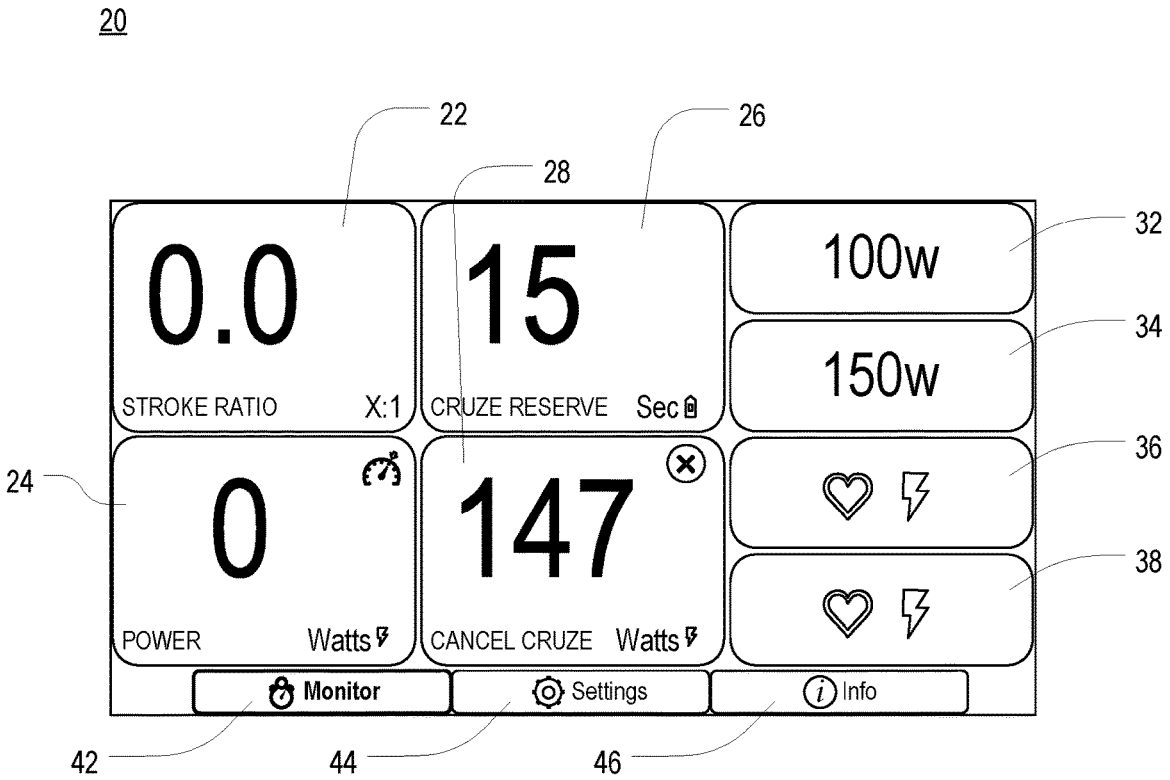

Once accumulated, the cruise reserve that has been accumulated may be used as shown in FIGS. 8A-8E. In FIG. 8A, exercise on the rowing machine 12 has stopped altogether as shown by the stroke ratio of 0.0 to 1 and current power of 0 watts. However, because 25 seconds of power are available at the set-point of 147 watts, the cruise control application 50 continues to output a power value equal to the set-point. Five seconds later, the cruise reserve has dropped to 20 seconds as shown in FIG. 8B, and five seconds after that, the cruise reserve has dropped to 15 seconds as shown in FIG. 8C. Notably, because cruise reserve is measured internally in watt-seconds (or equivalent units), in at least some embodiments the remaining time is calculated as follows:

remaining time=cruise reserve (in watt-seconds)/(set-point value−actual power value)

Thus, although not shown, the cruise reserve at the instant shown in FIG. 8C may be 147 watts×15 seconds=2205 watt-seconds. Thus, the remaining time is calculated as:

remaining time=2205 watt-seconds/(147 watts−0 watts)=15 seconds

Figure 8D:
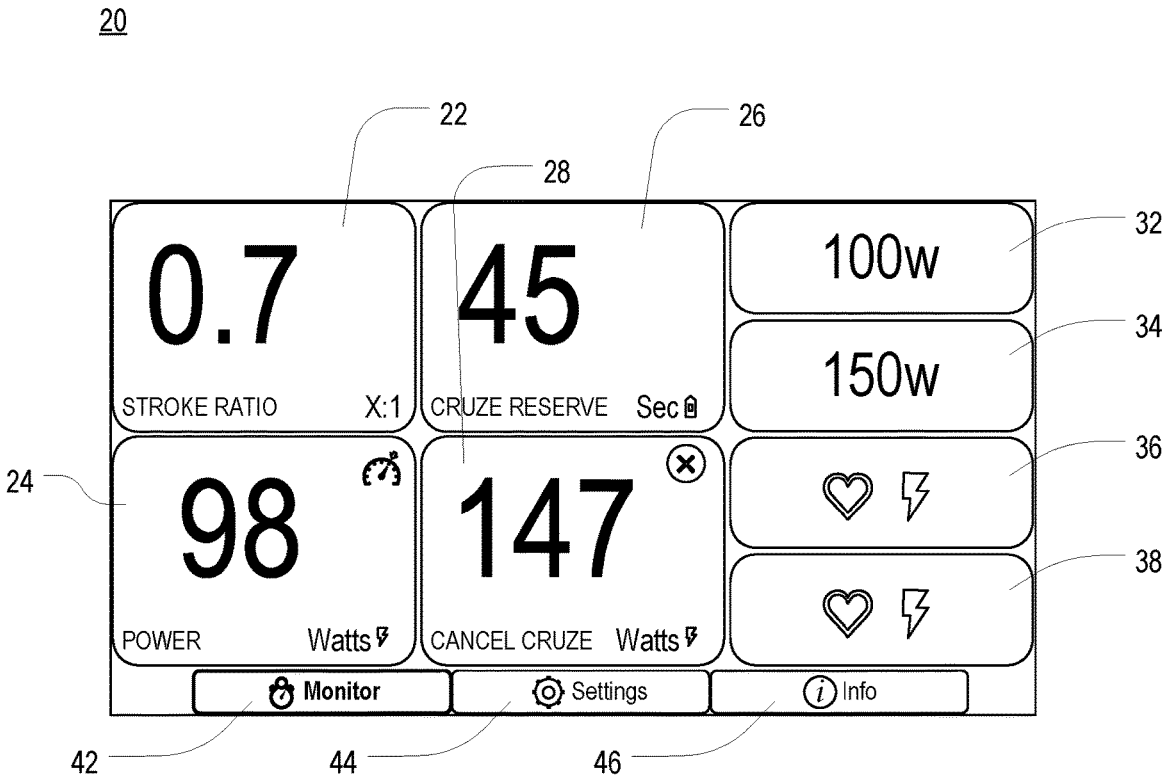

Thus, if the user 10 has merely slowed his or her workout, for example as shown in FIG. 8D, instead of stopping altogether, then the actual power being produced is factored into the remaining time. If the same 2205 watt-seconds are available in the cruise reserve, then the remaining time is calculated as:

remaining time=2205 watt-seconds/(147 watts−98 watts)=45 seconds

Figure 8E:
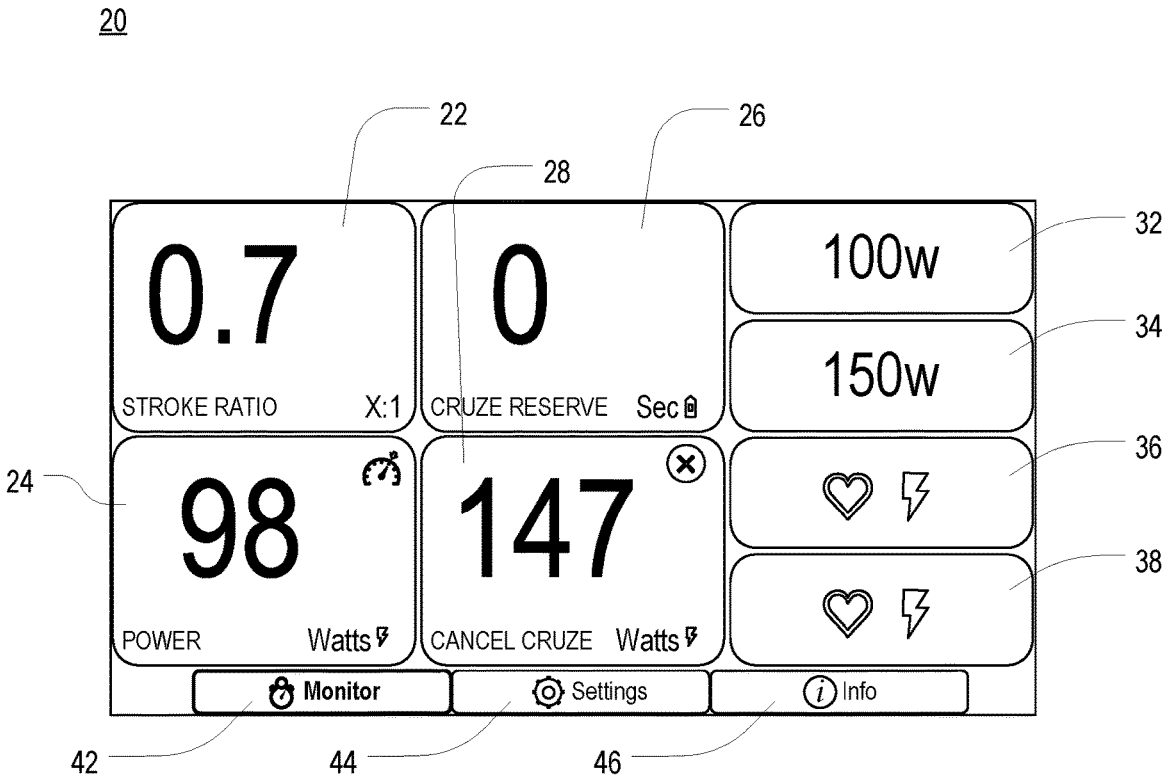

Therefore, if the user 10 maintains this level of workout power, 49 watt-seconds (147−98) of reserve power will be consumed every second and the cruise reserve will drop accordingly until the cruise reserve reaches 0 seconds as shown in FIG. 8E. At this point, the actual power will once again be reported to the trainer game 60. If the user 10 raises their power output above the set-point, the cruise will resume reporting its set-point and will begin accumulating cruise reserve power again.

Figure 9A:
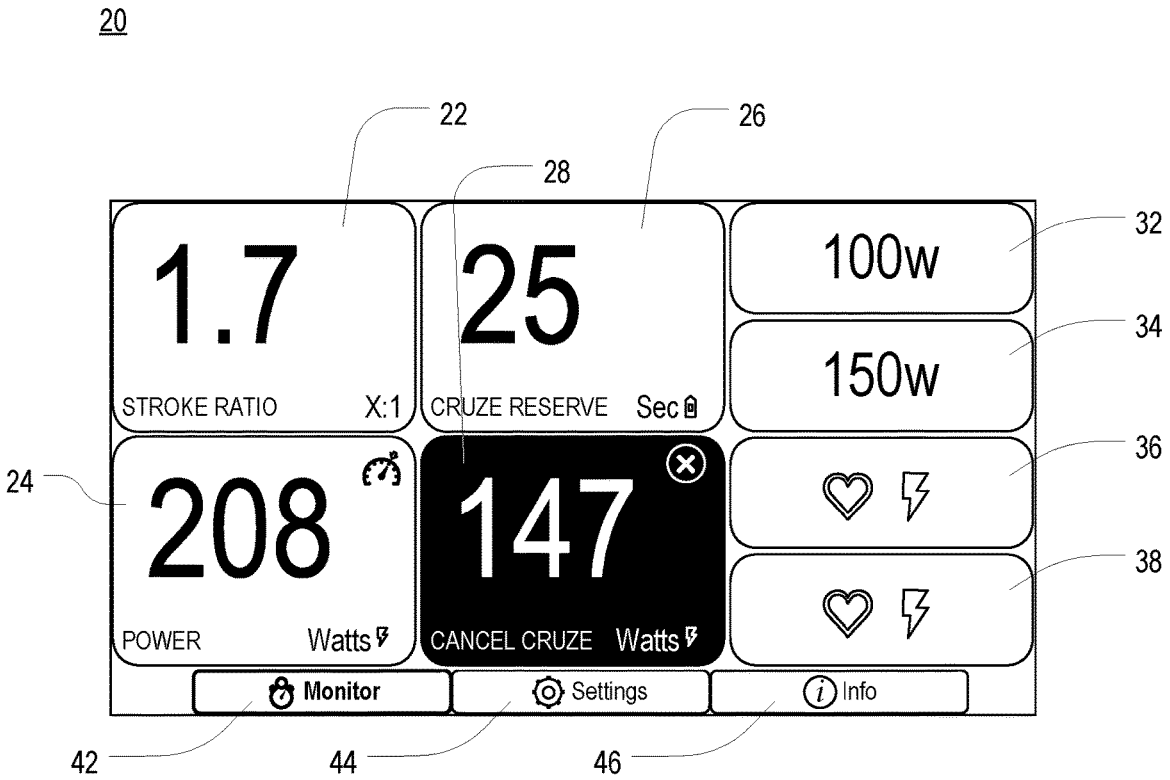
FIGS. 9A-9C are screenshots of the exemplary user interface of FIG. 3 further illustrating the second alternative mode of operation.
Figure 9B:
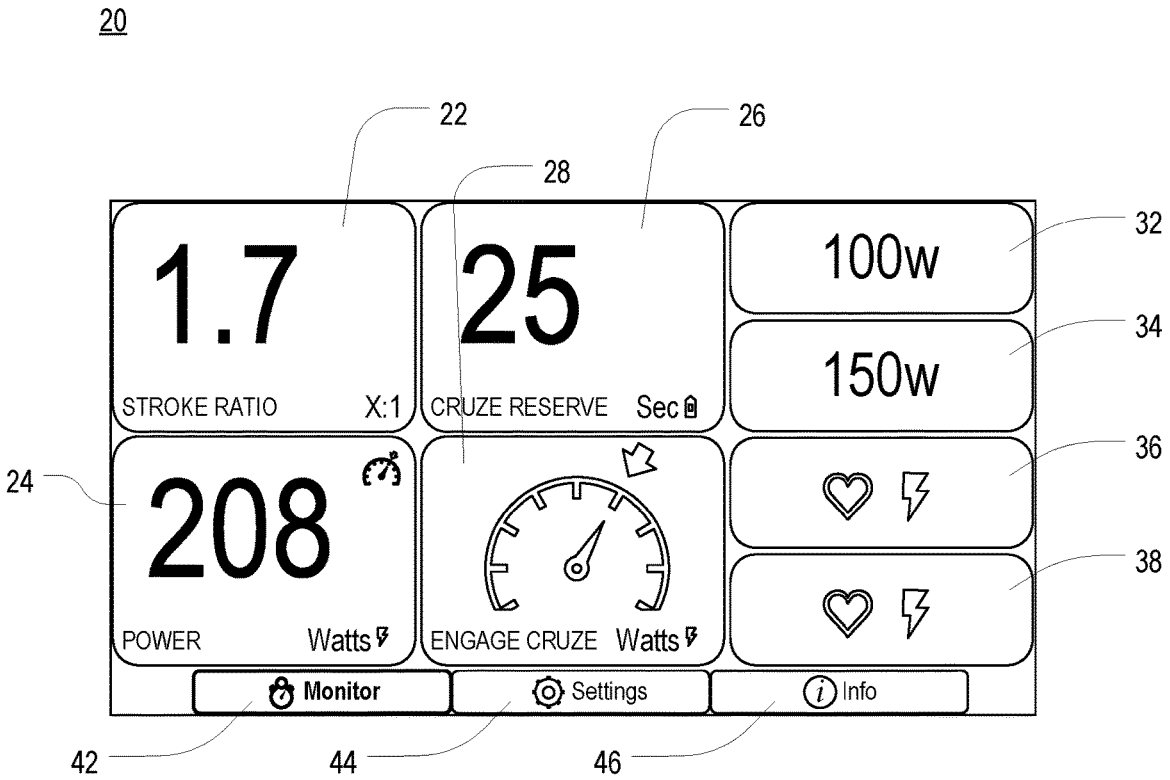
Figure 9C:
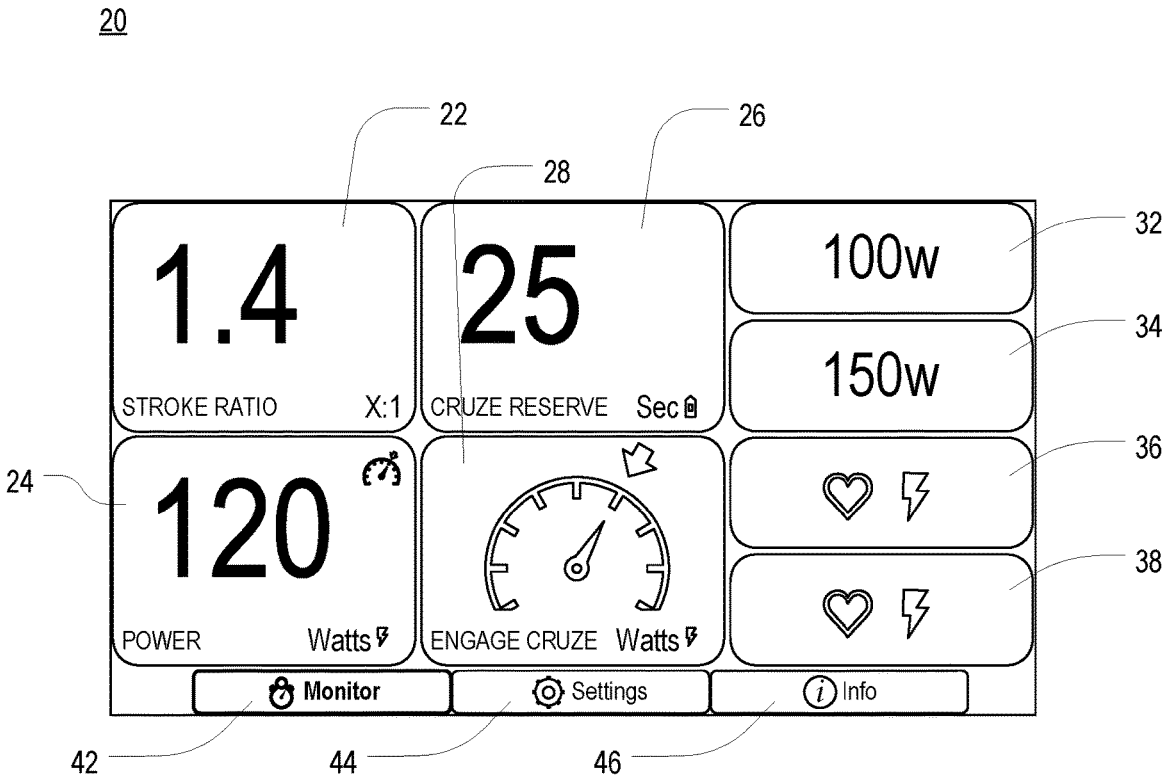

In at least some embodiments, it is not necessary for a user 10 to use accumulated cruise reserve immediately after accumulating it. This is illustrated in FIGS. 9A-9C. In FIG. 9A, the user disengages the cruise control by clicking the fourth primary interface area 28. As shown in FIG. 9B, the cruise control application 50 immediately resumes outputting the actual power being produced by user via the rowing machine 12, which at the time of disengagement is 208 watts. In FIG. 9C, the workout has progressed further. As shown therein, the stroke ratio has dropped to 1.4 to 1 and the current power dropped to 120 watts. Although the current power has thus dropped below the previous cruise control set-point of 147 watts, and cruise reserve is available, the cruise control function has been disengaged, so the cruise control application 50 continues to report the actual power, which in FIG. 9C is 120 watts. The cruise reserve is saved, at least for the time being, until the user choose to take advantage of it.

In some embodiments, the cruise reserve can be allowed to go negative, allowing the user to borrow power in the present and repay it in the future.

In another mode, the cruise reserve can be used to "ride out" communication dropouts with the control device 14, which would normally result in the user's avatar in a trainer game 60 to lose power. This is helpful due to the fact that fitness equipment communications (and thus control device communications) are often carried out with wireless protocols like ANT+ or Bluetooth that are subject to interference from WiFi, microwave ovens, and other wireless emitters. In this mode, if a communications dropout occurs, requiring the user to stop their workout and attend to their fitness equipment 12, control device 14, or computing device 16 to restore communications, the cruise control function can kick in automatically and keep the user's avatar "in the game" until the user can get communications re-established.

Thus, in the second mode of operation, the user 10 can vary their workout power above or below the cruise set-point while keeping the apparent workout power reported to the trainer game 60 at a steady amount (147 watts in the illustrations presented thus far), with power being accumulated in or consumed by the reserve as necessary.

Figure 10A:
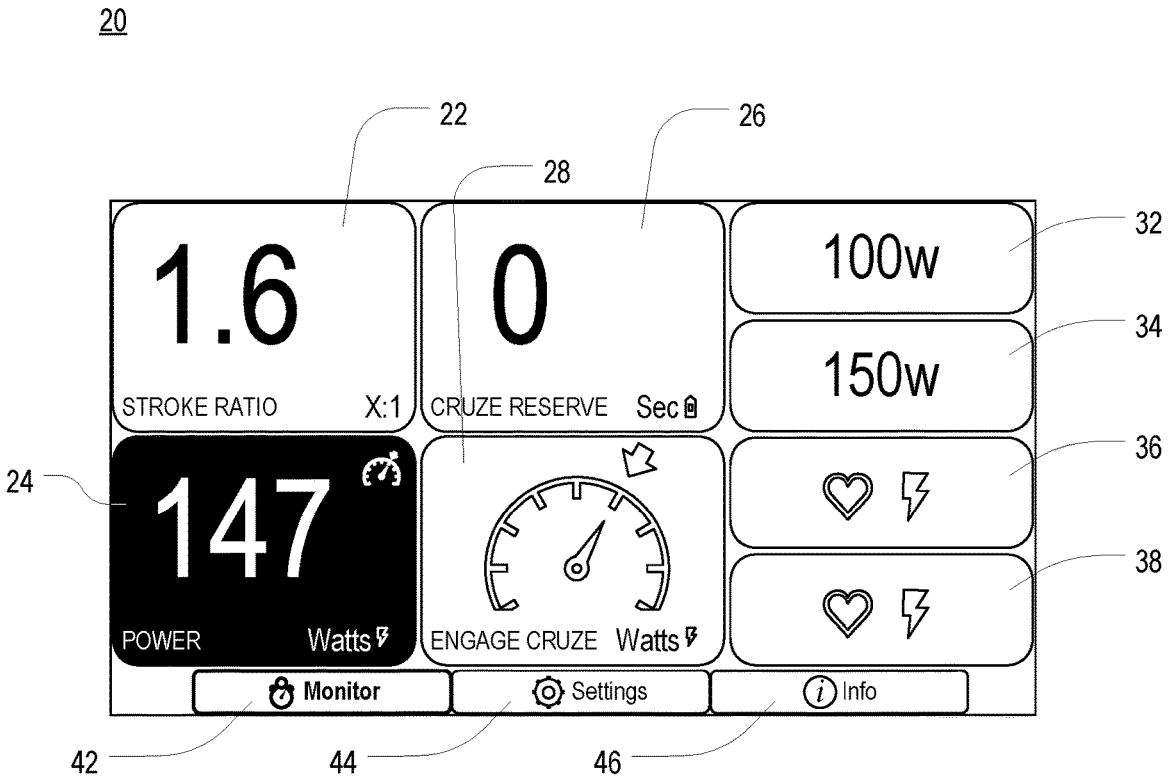
FIGS. 10A-10E are screenshots of the exemplary user interface of FIG. 3 further illustrating the second alternative mode of operation.
Figure 10B:
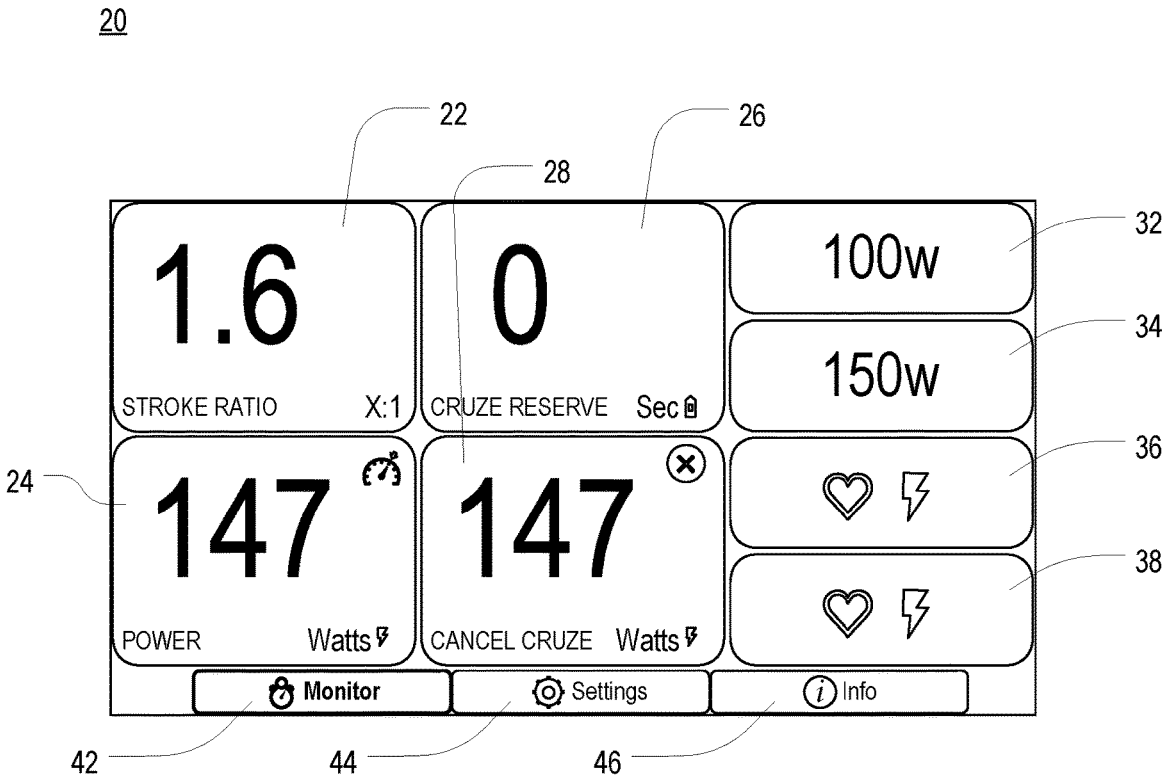
Figure 10C:
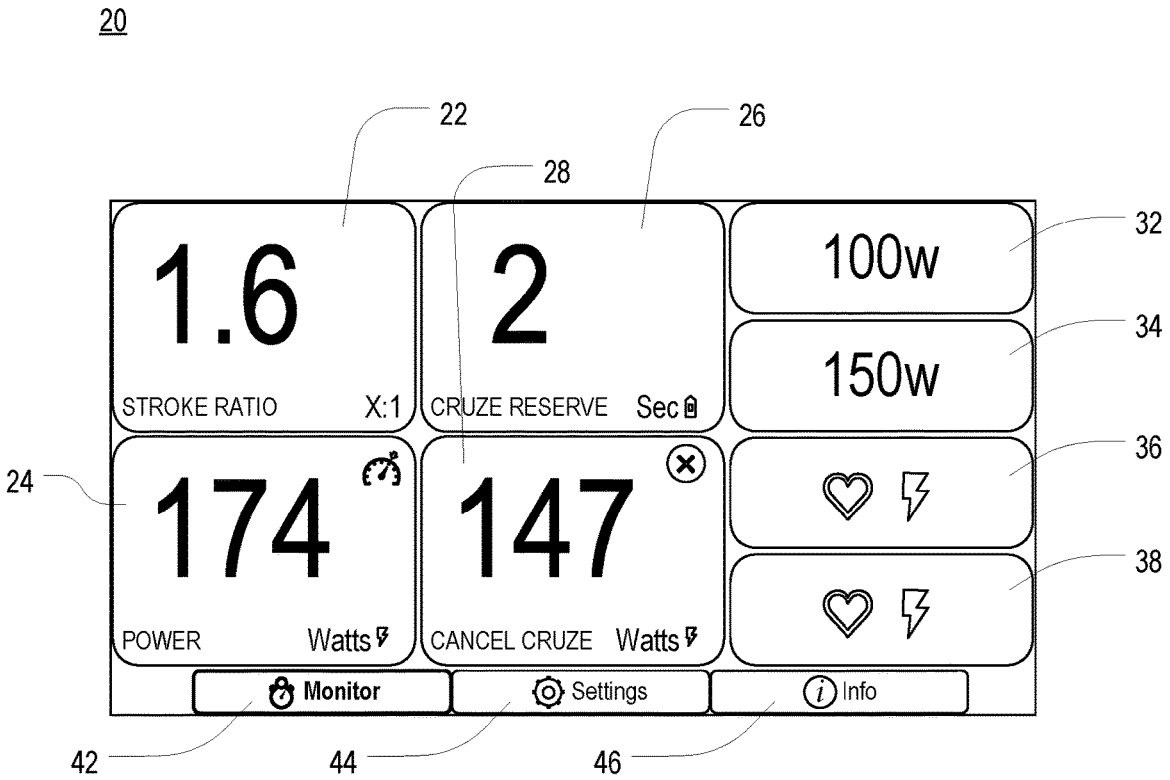
Figure 10D:
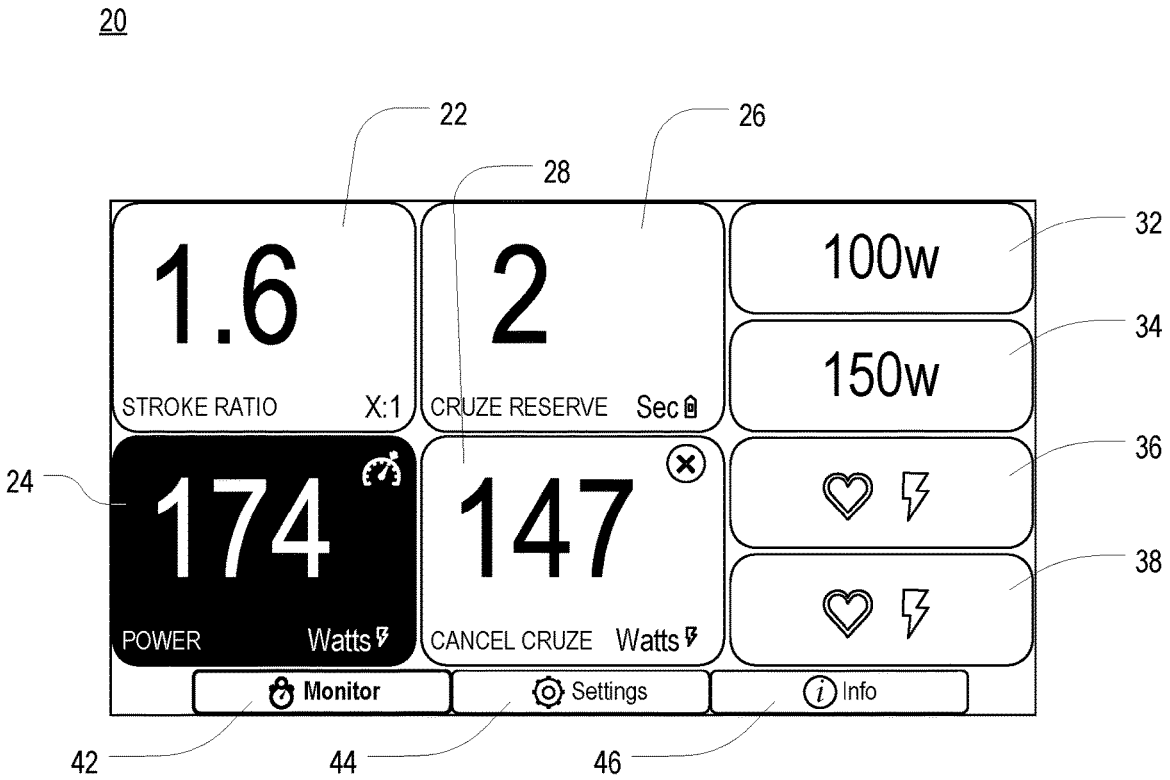
Figure 10E:
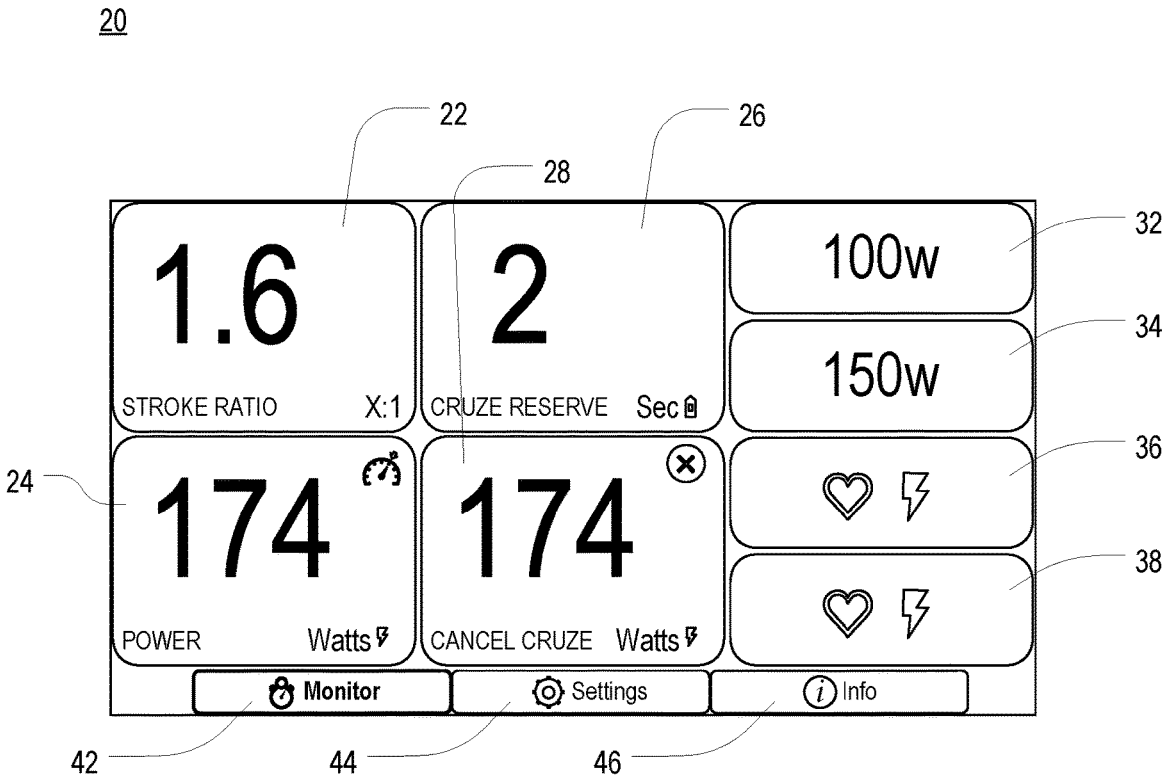

In at least some embodiments, the second primary interface area 24 (labeled "POWER") provides another alternative means for engaging the cruise control function and establishing the cruise control set-point. For example, from the state illustrated in FIG. 6C, the user may engage the cruise control by clicking the second primary interface area 24 as shown in FIG. 10A. As shown in FIG. 10B, the fourth primary interface area 28 then changes to show the cruise control set-point, and the fourth primary interface area 28 is relabeled "CANCEL CRUZE" and displays a cancel (X) icon to help the user understand that tapping it again will disengage the cruise control function and return to reporting actual workout power to the trainer game 60. (Notably, this is the same effect that is shown in FIG. 6E after engaging the cruise control function by clicking the fourth primary interface 28.) In at least some of these embodiments, the same button/primary interface area 24 may also be used to change the cruise control set-point while the cruise control function is already engaged. For example, if after engaging the cruise control function the user chooses to increase their actual power (thereby beginning to accumulate cruise reserve), the user could then change the set-point from its current value. This is illustrated in FIGS. 10C-10E. In FIG. 10C, the user has increased their actual power to 174 watts. In FIG. 10D, the user has clicked the second primary interface area 24, and in FIG. 10E the value shown in the second primary interface area 24 is established as the new cruise control set-point in the fourth primary interface area 28.

Figure 11A:
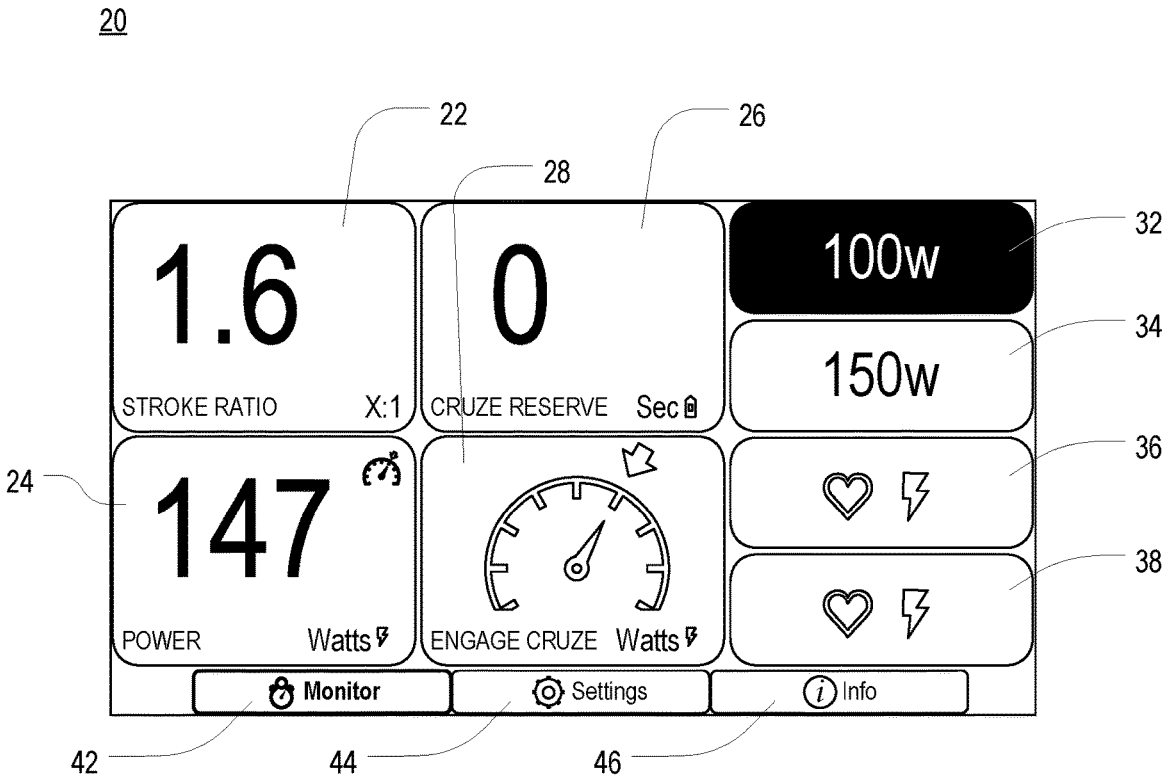
FIGS. 11A-11C are screenshots of the exemplary user interface of FIG. 3 further illustrating the second alternative mode of operation.
Figure 11B:
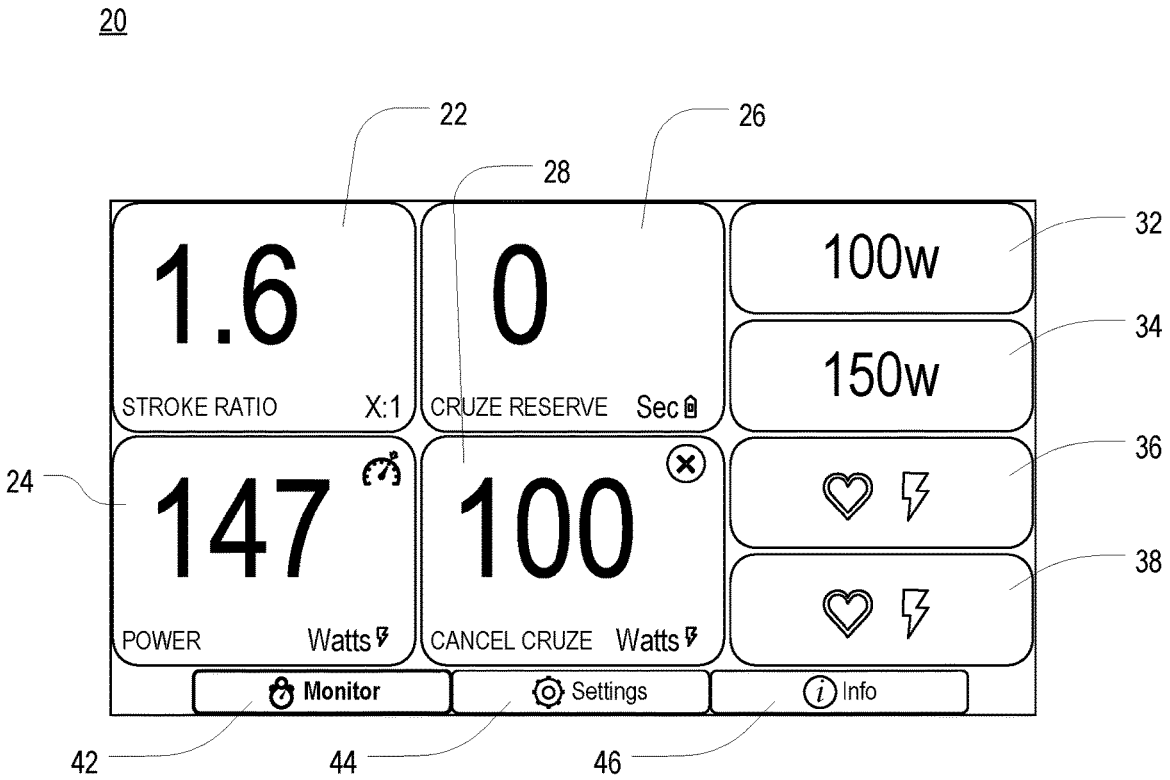
Figure 11C:
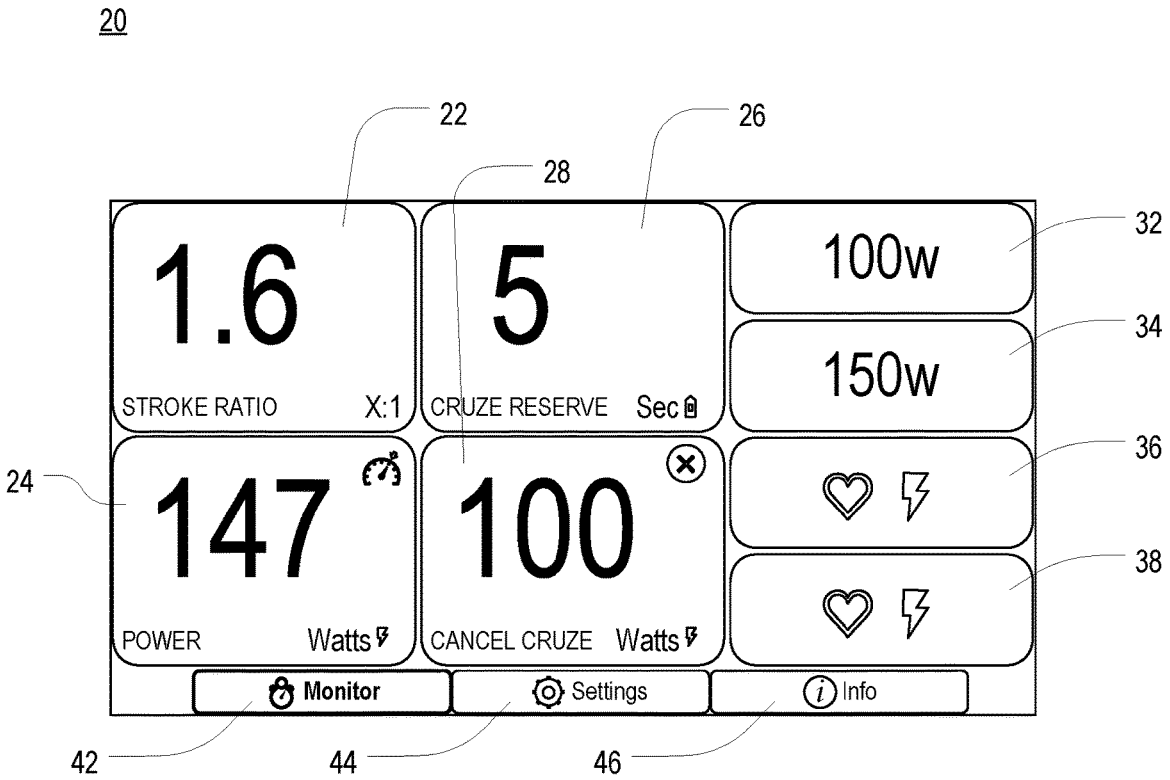

As described previously, the secondary interface areas 32,34,36,38 provide an alternative means, in at least some embodiments, for engaging the cruise control function. This is illustrated in FIGS. 6C, 11A, and 11B. In FIG. 6C, the user's workout had progressed to the point that the current stroke ratio was 1.6 to 1, and the current power was 147 watts. Rather than clicking the fourth primary interface area 28 to engage the cruise control function, as illustrated in FIG. 6D, the user can engage the function by clicking one of the preset workout power values available in the secondary interface areas 32,34,36,38. For example, in FIG. 11A, the user is clicking the "100w" preset value shown in the uppermost secondary interface areas 32. As shown in FIG. 11B, this engages the cruise control function at a set-point of 100 watts. As the workout progresses, the user 10 may accumulate cruise reserve if the workout power remains above the set-point, as shown in FIG. 11C. As noted previously, the values of the secondary interface areas 32,34,36,38 may be preset to application defaults, to values derived from previous workouts, to values input by a user, or to values determined in other ways. In some embodiments, a user may also use the presets of the secondary interface areas 32,34,36,38 to change the current set-point with the cruise control function already engaged. A user can then quickly switch the cruise set-point between power levels that are used frequently, such as when participating in a group workout that moves between a few specific power levels.

In some embodiments, preset values may be empty in one or more of the secondary interface areas 32,34,36,38, either at the time of software installation, at workout initiation, in response to certain user action, and/or in other circumstances. In the exemplary embodiment illustrated herein, heart and power icons are displayed on any secondary interface area 32,34,36,38 whose preset value is empty. In at least some of these embodiments, tapping an empty preset records the current workout power, which the preset then displays.

In at least some embodiments, features may be provided to help bridge differences between fitness equipment supporting continuous power measurements and fitness equipment where power must be measured only intermittently. For example, trainer games 60 may incorporate guided or coached workouts where athletes are instructed to raise or lower their power output to different target levels for periods of time. Sometimes these periods of time are relatively short and adjusting power output must be done rapidly. This can be done reasonably easily on a cycling trainer since cycling power can be measured continuously. On other fitness machines, however, power is delivered intermittently and has to be measured intermittently. For example, on rowing machines, measurements may only be done every 3-5 seconds after each stroke.

Trainer games 60 may reward the accuracy of power changes by the athletes in both timing and power level. To assist with this on "pulsed" fitness machines, the cruise control application may include the ability to capture "favorite" cruise control power level set-points that can be quickly recalled by the athlete 10 during his or her workout, allowing the athlete 10 to quickly adjust the apparent power output to the trainer game 60. If the set-point is above the athlete's current power output, the cruise control draws from available reserve as described above.

Notably, using cruise favorite set-points can lead to abrupt power changes being reported to the trainer games 60, which is "not natural." Thus, in at least some embodiments, acceleration and deceleration delay may be added to cruise control power changes so power changes appear to be typical for an actual athlete. Along the same lines, a cruise set-point that remains fixed at a specific power level over time is also not very natural. Another innovation is to allow the cruise set-point to drift up or downwards towards the athlete's actual power output. In at least some embodiments, the allowed amount and rate of drift can be programmable.

In at least some embodiments, the cruise control set-points may, in some cases, be adjusted automatically in response to a control signal from a trainer game 60, sometimes referred to as "erg mode." In this regard, it will be appreciated that some athletic fitness equipment 12 allows for external control of the effort required. A cycling trainer with controllable resistance to simulate gradients, like the Wahoo Kickr®, is an example. This allows trainer games 60 to provide a control signal to automatically adjust the amount of work the athlete is having to do. The same control signal can be used to change the cruise control set-point automatically under control of the trainer game 60, thus removing the need for the athlete 10 to manually change the cruise set-point.

When in "erg mode," it can be helpful to allow the user 10 to control how closely the cruise output power tracks the power level requested by the trainer game 60, giving the user 10 some latitude to match the requested power level on their own. This control can be exposed as a "window" value that will keep the output power within a percentage or absolute power value of the requested power. If the user produces power above or below the window, the cruise reserve is increased or reduced as described previously. For example, in a trainer game 60 that has erg mode enabled and is currently requesting the user to produce 100 watts, the user may have configured a 10% erg mode window. In such a situation, if the user 10 produces anywhere from 90-110 watts, their actual power will be reported to the trainer game 60, but if the user 10 produces less than 90 watts or more than 110 watts, their reported power will be clipped to those limits and cruise reserve will be consumed or replenished based on the difference outside of the window.

In at least some embodiments, the user interface 20 may use changes in color to provide additional status information. Such changes may be effected, for example, depending on whether cruise is engaged, if the reserve is being consumed or replenished, and/or the like. For example, in one or more contemplated embodiments, the reserve amount is normally displayed in white numbers, and the numbers remain white at the point when cruise is engaged, but the numbers change color during other states. For example, when the cruise reserve is being replenished, the numbers may appear in green; when the reserve is being consumed, the numbers may appear in yellow; and when the reserve is completely exhausted while the cruise engaged, the numbers may appear in red.

Figure 12:
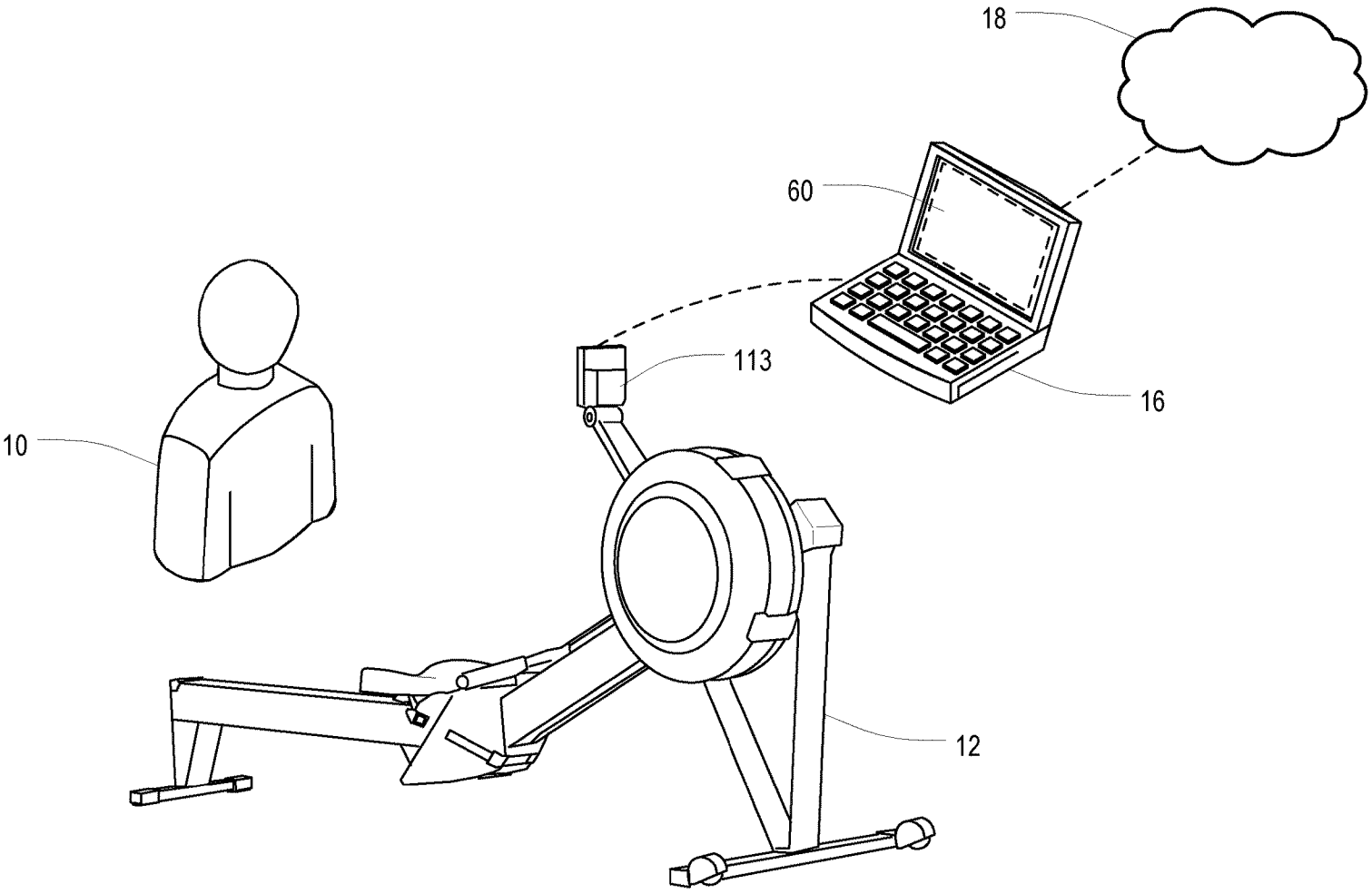
FIG. 12 is a schematic diagram illustrating the elements of another alternative exercise environment involving use of a cruise control function with a trainer game in accordance with one or more preferred embodiments of the present invention.

It will be appreciated that in one or more alternative embodiments, various aspects of the present invention may be deployed in other ways. In one deployment alternative, the functionality may be embedded in the fitness equipment itself. For example, a treadmill could incorporate a cruise reserve directly as a built-in feature by measuring power, implementing the cruise reserve and other functions, and then connecting to the computing device 16 and trainer game 60 by way of wireless communications, all implemented within the fitness machine's embedded electronic controller and user interface. An example of such an implementation is shown in FIG. 12, which is a schematic diagram illustrating the elements of another alternative exercise environment involving use of a cruise control function with a trainer game in accordance with one or more preferred embodiments of the present invention. In FIG. 12, the functionality of a cruise control application as described herein is incorporated into the software utilized by the equipment controller 113 for the fitness equipment, with the power output (virtual or actual) being reported to the computing device 16 and training game 60 directly, rather than via a separate control device 14. Operation of the fitness equipment 12 and equipment controller 113 is otherwise generally conventional.

In some embodiments, cycling power emulation could be provided in a separate internet of things (IoT) bridge device that communicates directly, such as via Bluetooth®, with the fitness machine 12 and presents it as a cycling emulator. The IoT device may have its own user interface on a touchscreen, or it might communicate over wireless with a mobile app to implement the user interface controls. Such a device might be particularly useful for providing functionality of the present invention for fitness equipment that only have USB or some other non-Bluetooth data connection. In yet another deployment alternative, an IoT bridge device could simply communicate all the way back to an internet server allowing the user interface to be remoted to any web browser.

Figure 13:
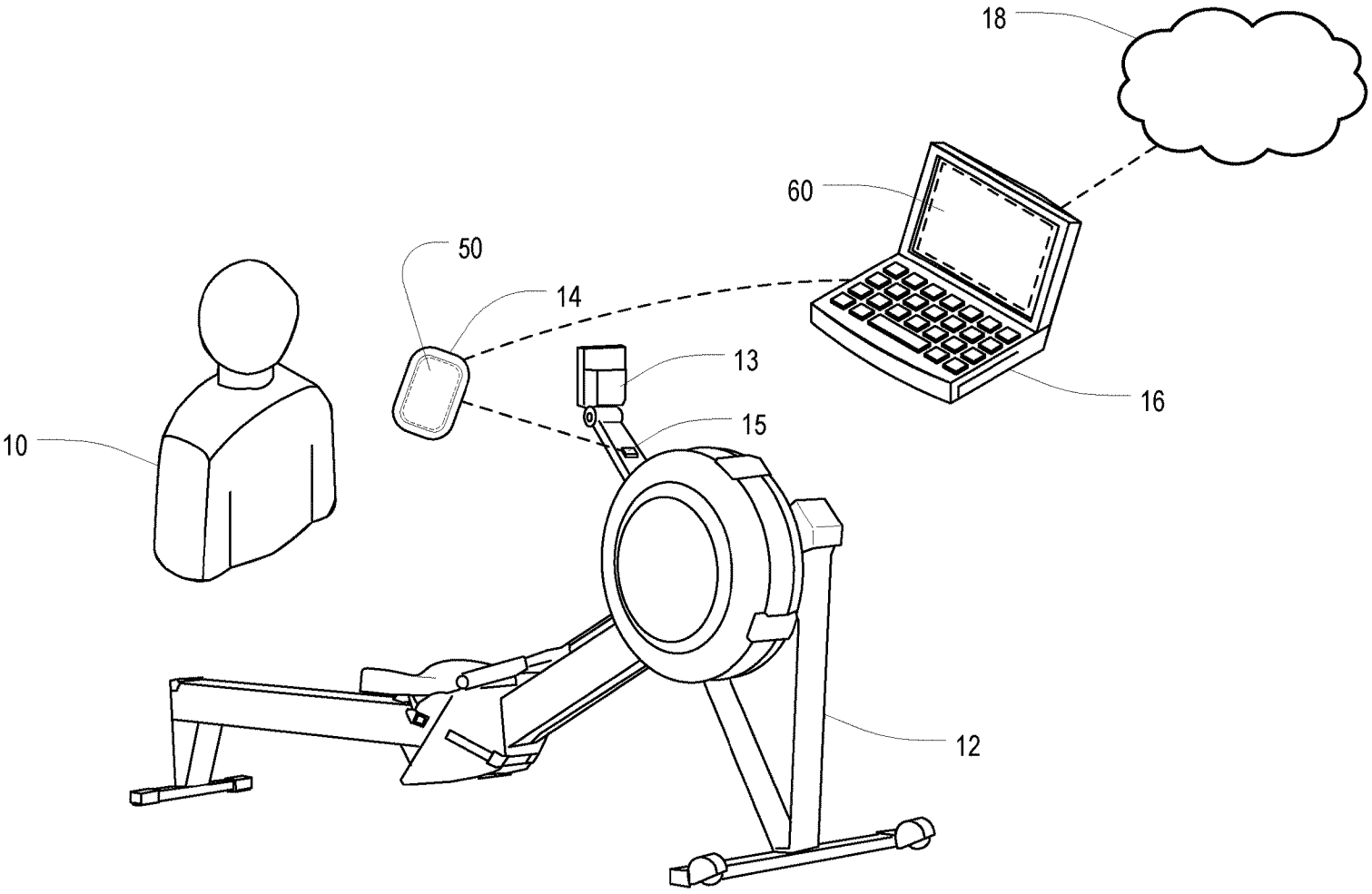
FIG. 13 is a schematic diagram illustrating the elements of another alternative exercise environment involving use of a cruise control function with a trainer game in accordance with one or more preferred embodiments of the present invention.

Some embodiments take advantage of the fact that some fitness machines 12 may have sensor connections for determining power output which are normally only used by the electronic fitness UI attached to the fitness machine. These sensor outputs can be input to an IoT or mobile device, usually with a machine-specific hardware adapter, and used to perform a separate power measurement which can then be used to control a trainer game. For example, the Concept2 and WaterRower rowing machines both have sense wires which carry electronic signals that correspond to the motion of the flywheel (in the case of the Concept2) or the paddle that moves the water in the tank of the WaterRower. Both of these signals can be readily interfaced and then used to measure the power of the fitness machine. An example of such an implementation is shown in FIG. 13, which is a schematic diagram illustrating the elements of another alternative exercise environment involving use of a cruise control function with a trainer game in accordance with one or more preferred embodiments of the present invention. In FIG. 13, an intermediate device 15 is shown interposed between the primary mechanical component of the fitness equipment 12 and the equipment controller 13. The intermediate device 15 receives a sensor output signal from a sensor and provides either a raw signal or a signal with actual power data to the control device 14.

Although not illustrated, it will be appreciated that in further alternative embodiments, various aspects of the present invention may be applied to provide connectivity to trainer games 60 for fitness machines (not shown) that have no instrumentation or connectivity. This may be accomplished, for example, via a camera or microphone on a control device or IoT device in conjunction with sound processing or OCR software as described previously, or via a purpose-built sensing device that communicates with the control device 14.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claim(s) appended hereto and the equivalents thereof.

What is claimed is:

1. A computer implemented method for providing a cruise control function, during a fitness equipment-based workout, to report a power output amount based on a cruise control set-point, comprising:

(a) during a workout carried out for a period of time on a piece of fitness equipment:

(i) producing, by the fitness equipment, an output corresponding to an actual amount of power being produced via operation of the fitness equipment by a user, (ii) receiving the output at an equipment controller, integrated into the piece of fitness equipment, or at a control device, (iii) at least intermittently transmitting, by the equipment controller or the control device, a data signal whose content includes a numerical indication of an amount of power to be used as an input by a fitness game or other application, wherein the fitness game or other application is implemented on a computing device, and wherein the numerical indication may or may not represent the actual amount of power being produced, (iv) receiving, at the computing device, the data signal, and (v) in the fitness game or other application, using the numerical indication included in the received data signal as the amount of power being produced by the user of the fitness equipment;

(b) wherein, in a first operational state, the numerical indication included in the content of the transmitted and received data signal represents the actual amount of power being produced via operation of the fitness equipment by the user; and (c) wherein, in a second operational state, the numerical indication included in the content of the transmitted and received data signal is a virtual power amount corresponding to a cruise control set-point amount that is established via, and under the control of, the equipment controller or the control device such that the fitness game or other application interprets the cruise control set-point amount as the actual amount of power being produced by the user of the fitness equipment.

2. The computer implemented method of claim 1, wherein the equipment controller or the control device implements a cruise control application that establishes the cruise control set-point amount.

3. The computer implemented method of claim 2, wherein the cruise control application controls whether the equipment controller or the control device is in the first operational state or the second operational state.

4. The computer implemented method of claim 3, further comprising a step of receiving, by the equipment controller or the control device, an input that establishes the cruise control set-point amount.

5. The computer implemented method of claim 4, wherein the step of receiving an input that establishes the cruise control set-point amount includes receiving an input that establishes the cruise control set-point amount as a current actual amount of power being produced via operation of the fitness equipment by the user.

6. The computer implemented method of claim 4, wherein the step of receiving an input that establishes the cruise control set-point amount includes receiving direct entry of a value to be used as the cruise control set-point amount.

7. The computer implemented method of claim 4, wherein the step of receiving an input that establishes the cruise control set-point amount includes selection of a pre-defined set-point value, from a plurality of different pre-defined set-point values, and using the selected value as the cruise control set-point amount.

8. The computer implemented method of claim 3, further comprising a step, while in the first operational state, of receiving, by the equipment controller or the control device, an input interpreted as a command to change from the first operational state to the second operational state.

9. The computer implemented method of claim 8, further comprising a subsequent step, while in the second operational state, of receiving, by the equipment controller or the control device, an input interpreted as a command to change from the second operational state back to the first operational state.

10. The computer implemented method of claim 8, further comprising a subsequent step, while in the second operational state, of forcing operation to return from the second operational state back to the first operational state when a particular condition exists as determined by the equipment controller or the control device.

11. The computer implemented method of claim 3, wherein the operation of the equipment controller or the control device in the second operational state is related to accumulation of reserve power as tracked by the cruise control application, wherein the accumulated reserve power is measured in units of power per unit of time; and wherein:

(f) the reserve power is accumulated based on the difference between the actual amount of power amount produced and the virtual power amount over a period of time; and (g) the reserve power is depleted based on the difference between the virtual power amount and the actual amount of power amount produced over a period of time.

12. The computer implemented method of claim 1, wherein the fitness equipment includes a sensor that detects one or more attributes corresponding to mechanical motion of the fitness equipment and outputs a signal along a communication path from the sensor to the integrated equipment controller, wherein the method further comprises intercepting the sensor output signal at an intermediate device, wherein the output produced by the fitness equipment is the sensor output signal, and wherein the equipment controller or the control device implements software that converts the sensor output signal into a numerical indication of the actual amount of power being produced via operation of the fitness equipment by the user.

13. The computer implemented method of claim 1, wherein the fitness equipment includes a sensor that detects one or more attributes corresponding to mechanical motion of the fitness equipment and outputs a signal along a communication path from the sensor to the integrated equipment controller, wherein the method further comprises intercepting the sensor output signal at an intermediate device, wherein the output produced by the fitness equipment is the sensor output signal, and wherein the sensor output signal includes a numerical indication of the actual amount of power being produced via operation of the fitness equipment by the user.

14. A computer implemented method for providing a cruise control function, during a fitness equipment-based workout, to report a power output amount based on a cruise control set-point, comprising:

(a) during a workout carried out for a period of time on a piece of fitness equipment:

(i) receiving, at a control device, an output corresponding to an actual amount of power being produced via operation of the fitness equipment, (ii) at least intermittently transmitting, by the control device, a data signal whose content includes a numerical indication of an amount of power to be used as an input by a fitness game or other application, wherein the fitness game or other application is implemented on a computing device, and wherein the numerical indication may or may not represent the actual amount of power being produced, but wherein the numerical indication included in the received data signal is intended to be used in either case as the amount of power being produced by the user of the fitness equipment;

(b) wherein, in a first operational state, the numerical indication included in the content of the transmitted and received data signal represents the actual amount of power being produced via operation of the fitness equipment by the user; and (c) wherein, in a second operational state, the numerical indication included in the content of the transmitted and received data signal is a virtual power amount corresponding to a cruise control set-point amount that is established via, and under the control of, the control device such that the fitness game or other application interprets the cruise control set-point amount as the actual amount of power being produced by the user of the fitness equipment.

15. The computer implemented method of claim 14, wherein the control device implements a cruise control application that establishes the cruise control set-point amount.

16. The computer implemented method of claim 15, wherein the cruise control application controls whether the control device is in the first operational state or the second operational state.

17. The computer implemented method of claim 16, wherein the operation of the control device in the second operational state is related to accumulation of reserve power as tracked by the cruise control application.

18. A computer implemented system for providing a cruise control function, during a fitness equipment-based workout, to report a power output amount based on a cruise control set-point, comprising:

(a) a piece of fitness equipment that produces an output corresponding to an actual amount of power being produced via operation of the fitness equipment by a user;

(b) a control device that receives the output from the fitness equipment and at least intermittently transmits a data signal whose content includes a numerical indication of an amount of power to be used as an input by a fitness game or other application, and wherein the numerical indication may or may not represent the actual amount of power being produced; and (c) a computing device that implements the fitness game or other application, wherein the computing device receives the data signal and uses the numerical indication included in the received data signal as the amount of power being produced by the user of the fitness equipment;

(d) wherein, in a first operational state, the numerical indication included in the content of the transmitted and received data signal represents the actual amount of power being produced via operation of the fitness equipment by the user; and (e) wherein, in a second operational state, the numerical indication included in the content of the transmitted and received data signal is a virtual power amount corresponding to a cruise control set-point amount that is established via, and under the control of, the control device such that the fitness game or other application interprets the cruise control set-point amount as the actual amount of power being produced by the user of the fitness equipment.

19. The computer implemented system of claim 18, wherein the control device implements a cruise control application that establishes the cruise control set-point amount, wherein the cruise control application controls whether the control device is in the first operational state or the second operational state, and wherein the operation of the control device in the second operational state is related to accumulation of reserve power as tracked by the cruise control application.

* * * * *